US011710919B2

(12) United States Patent
Sato

(10) Patent No.: US 11,710,919 B2
(45) Date of Patent: Jul. 25, 2023

(54) ELECTRICAL CONNECTOR WITH FLAT-TYPE CONDUCTORS, COUNTERPART ELECTRICAL CONNECTOR AND ELECTRICAL CONNECTOR ASSEMBLY

(71) Applicant: Hirose Electric Co., Ltd., Kanagawa (JP)

(72) Inventor: Seitaro Sato, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/479,601

(22) Filed: Sep. 20, 2021

(65) Prior Publication Data

US 2022/0109260 A1 Apr. 7, 2022

(30) Foreign Application Priority Data

Oct. 1, 2020 (JP) ..... 2020-167117

(51) Int. Cl.

| | |
|---|---|
| ***H01R 12/79*** | (2011.01) |
| ***H01R 12/59*** | (2011.01) |
| ***H01R 13/629*** | (2006.01) |
| ***H01R 12/77*** | (2011.01) |

(52) U.S. Cl.
CPC ..... *H01R 12/79* (2013.01); *H01R 12/592* (2013.01); *H01R 12/772* (2013.01); *H01R 13/629* (2013.01)

(58) Field of Classification Search
None
See application file for complete search history.

(56) References Cited

U.S. PATENT DOCUMENTS 5,240,420 A * 8/1993 Roberts ..... H01R 12/79 439/62

FOREIGN PATENT DOCUMENTS

JP 2012-138293 A 7/2012

* cited by examiner

*Primary Examiner* — Ross N Gushi
(74) *Attorney, Agent, or Firm* — Procopio, Cory, Hargreaves & Savitch LLP

(57) ABSTRACT

To provide an electrical connector with flat-type conductors, a counterpart electrical connector, and an electrical connector assembly, in which the size of the connector is not increased in the thickness direction of the flat-type conductors when using two flat-type conductors disposed in parallel opposite each other.

6 Claims, 12 Drawing Sheets

ELECTRICAL CONNECTOR WITH FLAT-TYPE CONDUCTORS, COUNTERPART ELECTRICAL CONNECTOR AND ELECTRICAL CONNECTOR ASSEMBLY

CROSS-REFERENCE TO RELATED APPLICATIONS

This application claims priority to Japanese Patent Application No. 2020-167117, filed Oct. 1, 2020, the contents of which are incorporated herein by reference in its entirety for all purposes.

TECHNICAL FIELD

The present invention relates to an electrical connector with flat-type conductors, a counterpart electrical connector mated thereto, and an electrical connector assembly including both connectors.

BACKGROUND ART

A connector that receives the front end portion of a flat-type conductor with a strip-like configuration extending in a forward-backward direction and that has said flat-type conductor electrically connected thereto has been disclosed in Patent Document 1. In Patent Document 1 above, only one flat-type conductor (referred to as "flexible printed wiring board" in Patent Document 1) is configured to be connected to the connector (connector device). This flat-type conductor has contact portions on both faces of the front end portion, such that the contact portions on one face serve as contact portions used for signal wiring (connecting terminal portions), and the contact portions on the other face serve as contact portions used for grounding (ground contact portions).

In order to prevent inadvertent decoupling from the connector, engageable portions engageable by engagement portions provided in the connector are formed in the front end portion of the flat-type conductor. In concrete terms, the engageable portions (notch engagement portions) are formed by notching out portions of the opposite side edges of the front end portion of the flat-type conductor, and are able to be engaged by the engagement portions of the connector. Given that strength is required of the front end portion of the flat-type conductor because of being acted upon by the force of engagement with the engagement portions and, in addition, that stiffness is needed during insertion into the connector, said front end portion is made of thicker base material than the rear portion.

Although in Patent Document 1, as described above, the contact portions used for signal wiring are provided on one face and the contact portions used for grounding are provided on the other face, in a flat-type conductor having contact portions formed on both faces in this manner, it is also possible to use the contact portions of both faces for signal wiring. In such a case, a creepage distance between signal wires on both faces needs to be ensured, which also requires an increase in the thickness of the front end portion of the flat-type conductor.

PRIOR ART DOCUMENTS

Patent Documents

Patent Document 1

U.S. Pat. No. 5,093,340

SUMMARY

Problems to be Solved by the Invention

Thus, considerable thickness is required of a flat-type conductor having contact portions on both faces of the front end portion. Since the terminals of the connector contacting the contact portions on both faces when the front end portion of such a flat-type conductor is connected to the connector are positioned on top of the contact portions of the flat-type conductor, the dimensions of the connector in the thickness direction of the flat-type conductor are increased, and this leads to an increase in the size of the connector itself. In addition to cases in which the contact portions are formed on both faces of a single flat-type conductor such as the one used in Patent Document 1, the same also holds true for cases in which connection to the connector is made in a state where two flat-type conductors extending in the forward-backward direction are placed opposite each other in the thickness direction thereof and the contact portions of the respective flat-type conductors are positioned on the exterior side faces oriented in opposite directions (opposite faces). At such time, in order to ensure adequate contact pressure between the contact portions of the flat-type conductors and the terminals of the counterpart electrical connector (counterpart terminals), the resilient deformation of the front end portions of the respective flat-type conductors needs to be minimized by increasing the stiffness of said front end portions, which also requires an increase in the thickness of the front end portions of the flat-type conductors.

In view of the aforesaid circumstances, it is an object of the present invention to provide an electrical connector with flat-type conductors, a counterpart electrical connector, and an electrical connector assembly in which the size of the connector in the thickness direction of the flat-type conductors is not increased when using two flat-type conductors disposed in parallel opposite each other.

Means for Solving the Problems

In accordance with the present invention, the above-described problem is solved by the following electrical connector with flat-type conductors according to a first invention, counterpart electrical connector according to a second invention, and electrical connector assembly according to a third invention.

First Invention

The electrical connector with flat-type conductors according to the first invention is an electrical connector with flat-type conductors intended for matingly connecting the front end sections of two flat-type conductors with a strip-like configuration extending in the forward-backward direction to a counterpart electrical connector, and has the two flat-type conductors, a housing holding the front end sections of the two flat-type conductors, and a retainer attached to the housing in a manner to support the front end sections of the two flat-type conductors.

Such an electrical connector with flat-type conductors in the first invention is characterized by the fact that the flat-type conductors have a plurality of contact portions intended for connection to the counterpart electrical connector that are arranged in the strip width direction of the flat-type conductors and are exposed on one of the faces of the front end sections; the two flat-type conductors, in which said one faces whereon the contact portions are arranged are used as interior side faces, have a pair of said interior side faces placed in a face-to-face relationship at locations spaced apart from each other in the thickness direction of said flat-type conductors, and have a receiving space intended for receiving a nesting portion in which the counterpart contact portions of the counterpart terminals provided in the counterpart electrical connector are arranged formed between the pair of interior side faces of the front end sections of the two flat-type conductors; the housing has a mating portion which, along with holding and being able to support the front end sections of the two flat-type conductors, mates with a counterpart housing provided in the counterpart electrical connector; the mating portion has mating walls that are in a face-to-face relationship with the exterior side faces constituting the other faces located on the sides opposed to said one faces of the front end sections of the flat-type conductors, and can support the exterior side faces of the flat-type conductors with said mating walls; and the retainer is positioned between the two flat-type conductors at a different location in the forward-backward direction than the receiving space in the forward-backward direction and is enabled to support the two flat-type conductors in conjunction with the housing.

In the electrical connector with flat-type conductors according to the first invention, two flat-type conductors are disposed such that the contact portions are positioned on the respective interior side faces and the receiving space is formed between the pair of interior side faces. In other words, the respective contact portions of the two flat-type conductors are spaced apart by the size of the receiving space in the thickness direction of the flat-type conductors, which ensures a sufficiently large creepage distance between the two flat-type conductors. In addition, when the connectors are in a mated state, the nesting portion of the counterpart electrical connector is nested within the receiving space and the counterpart contact portions of the counterpart terminals disposed in said nesting portion are brought into contact with the contact portions on the interior side faces of the flat-type conductors under contact pressure. Therefore, the counterpart terminals are not positioned proximate to the exterior side faces of the two flat-type conductors and the dimensions of the connector in the thickness direction of the flat-type conductors can be reduced in comparison with conventional connectors in a proportionate manner. In addition, although the contact portions of the flat-type conductors are subject to pressure from the counterpart contact portions when the connectors are in a mated state, the exterior side faces of the front end portions of the flat-type conductors are supported by the mating walls of the housing and resilient deformation of said front end portions is minimized, which makes it possible to ensure a sufficiently high contact pressure between the contact portions and the counterpart contact portions. Therefore, there is no longer need to increase the thickness of the front end portions of the flat-type conductors and, consequently, an increase in the size of the connector itself in the thickness direction can be avoided.

Second Invention

The counterpart electrical connector according to the second invention is a counterpart electrical connector matingly connected to the electrical connector with flat-type conductors according to the first invention and comprises a plurality of counterpart terminals arranged in alignment with the plurality of the contact portions of the two flat-type conductors and a counterpart housing retaining the plurality of terminals in place, and is characterized by the fact that the plurality of counterpart terminals have one set of counterpart terminals corresponding to one flat-type conductor and another set of counterpart terminals corresponding to the other flat-type conductor, and said one set and said other set of counterpart terminals are configured to be arranged in the nesting portion entering the receiving space of the electrical connector with flat-type conductors and to be brought into contact with the contact portions of the respective corresponding flat-type conductors once the connectors are connected.

When the connectors are in a mated state, said one set and said other set of counterpart terminals provided in this counterpart electrical connector enter the receiving space of the electrical connector with flat-type conductors, i.e., between the pair of interior side faces of the front end portions of the two flat-type conductors. In other words, neither said one set nor said other set of counterpart terminals is located proximate to the exterior side faces of the front end portions of the two flat-type conductors, and therefore, an increase in the size of counterpart electrical connector in the thickness direction can be avoided.

The second invention may be adapted such that the plurality of counterpart terminals have counterpart contact portions that can be brought into contact with the contact portions of the flat-type conductors by undergoing resilient displacement in the thickness direction of the flat-type conductors; the counterpart contact portions of the counterpart terminals of said one set of counterpart terminals and the counterpart contact portions of the counterpart terminals of said other set of counterpart terminals are disposed in different locations in the strip width direction of the flat-type conductors; and the ranges of resilient displacement between the counterpart contact portions of the counterpart terminals of said one set of counterpart terminals and the counterpart contact portions of the counterpart terminals of said other set of counterpart terminals overlap at least partially in the thickness direction when viewed in the strip width direction of the flat-type conductors once the counterpart electrical connector has been connected to the electrical connector with flat-type conductors and the counterpart contact portions of the plurality of counterpart terminals have been resiliently displaced.

Using such a configuration enables the counterpart contact portions of the different sets of counterpart terminals to share space within the thickness direction range of the flat-type conductors once the connectors are in a mated state, that is, once the respective counterpart contact portions of the counterpart terminals of said one set of counterpart terminals and the counterpart contact portions of the counterpart terminals of said other set of counterpart terminals have been resiliently displaced, and thus makes it possible to reduce the dimensions of the counterpart electrical connector and, by extension, the electrical connector with flat-type conductors in said thickness direction.

Third Invention

The electrical connector assembly according to the third invention is an electrical connector assembly having the electrical connector with flat-type conductors according to the first invention and the counterpart electrical connector according to the second invention, and is characterized by the fact that the counterpart housing of the counterpart electrical connector has a counterpart mating portion which, along with holding the counterpart contact portions of the plurality of counterpart terminals, receives the mating portion of the housing of the electrical connector with flat-type conductors; and the counterpart mating portion has counterpart mating walls placed in a face-to-face relationship with the exterior surfaces of said mating walls once said counterpart mating portion has received the mating portion, and supports the exterior surfaces of the mating walls with the interior surfaces of the counterpart mating walls.

In the third invention, the exterior surfaces of the mating walls of the mating portion are configured to be supported by the interior surfaces of the counterpart mating walls of the counterpart mating portion once the connectors are in a mated state, that is, once the counterpart mating portion of the counterpart electrical connector has received the mating portion of the electrical connector with flat-type conductors. Therefore, the wall thickness dimensions of said mating portion (dimensions in the thickness direction of the flat-type conductors) can be made smaller, and the dimensions of both connectors in the thickness direction of the flat-type conductors can be reduced in a proportionate manner.

The third invention may be adapted such that the counterpart mating walls of the counterpart electrical connector have support protrusions protruding toward the exterior surfaces of the mating walls of the electrical connector with flat-type conductors on the interior surfaces of said counterpart mating walls, and, once the counterpart mating portion has received the mating portion, support the exterior surfaces of the mating walls with the protruding apical faces of the support protrusions.

Providing the support protrusions on the interior surfaces of the counterpart mating walls in this manner allows the counterpart mating walls to support the exterior surfaces of the mating walls with the protruding apical faces of the support protrusions locally, and not across the entire extent of the interior surfaces thereof, which provides for more reliable support.

The third invention may be adapted such that the mating walls have groove portions that extend along the exterior surfaces of said mating walls in the forward-backward direction and can receive the support protrusions from the front, and the support protrusions, in conjunction with the groove portions, limit the relative movement of the electrical connector with flat-type conductors and the counterpart electrical connector in the strip width direction of the flat-type conductors.

The support protrusions of the counterpart electrical connector enter the groove portions of the electrical connector with flat-type conductors when the connectors are in a mated state and limit the relative movement of the connectors in the strip width direction of the flat-type conductors, as a result of which the position of both connectors in the strip width direction can be adequately fixed.

In the third invention, the support protrusions, when viewed in the strip width direction of the flat-type conductors, may be formed extending over a range comprising the locations of contact between the contact portions of the flat-type conductors and the counterpart contact portions of the counterpart terminals in the forward-backward direction.

Since the support protrusions are formed within a range comprising the locations of contact in the forward-backward direction, even if the wall thickness of the mating walls of the electrical connector with flat-type conductors is small, the protruding apical faces of the support protrusions of the counterpart electrical connector support the exterior surfaces of the mating walls within the above-mentioned range and minimize the resilient deformation of said mating walls, thereby ensuring an adequate contact pressure between the contact portions and the counterpart contact portions at the locations of contact.

Effects of the Invention

In the present invention, as described above, when the connectors are in a mated state, the nesting portion of the counterpart electrical connector is nested within the receiving space and the counterpart contact portions of the counterpart terminals disposed in said nesting portion are brought into contact with the contact portions on the interior side faces of the flat-type conductors under contact pressure. Therefore, the counterpart terminals are not positioned proximate to the exterior side faces of the two flat-type conductors and the dimensions of the connector in the thickness direction of the flat-type conductors can be reduced in comparison with conventional connectors in a proportionate manner. In addition, since the exterior side faces of the front end portions of the flat-type conductors are supported by the mating walls of the housing, the resilient deformation of said front end portions is minimized, and a sufficiently high contact pressure between the contact portions and the counterpart contact portions can be ensured, it is no longer necessary to increase the thickness of the front end portions of the flat-type conductors and, consequently, an increase in the size of the connector in the thickness direction can be avoided.

DETAILED DESCRIPTION

Embodiments of the present invention are described below with reference to the accompanying drawings.

Figure 1:
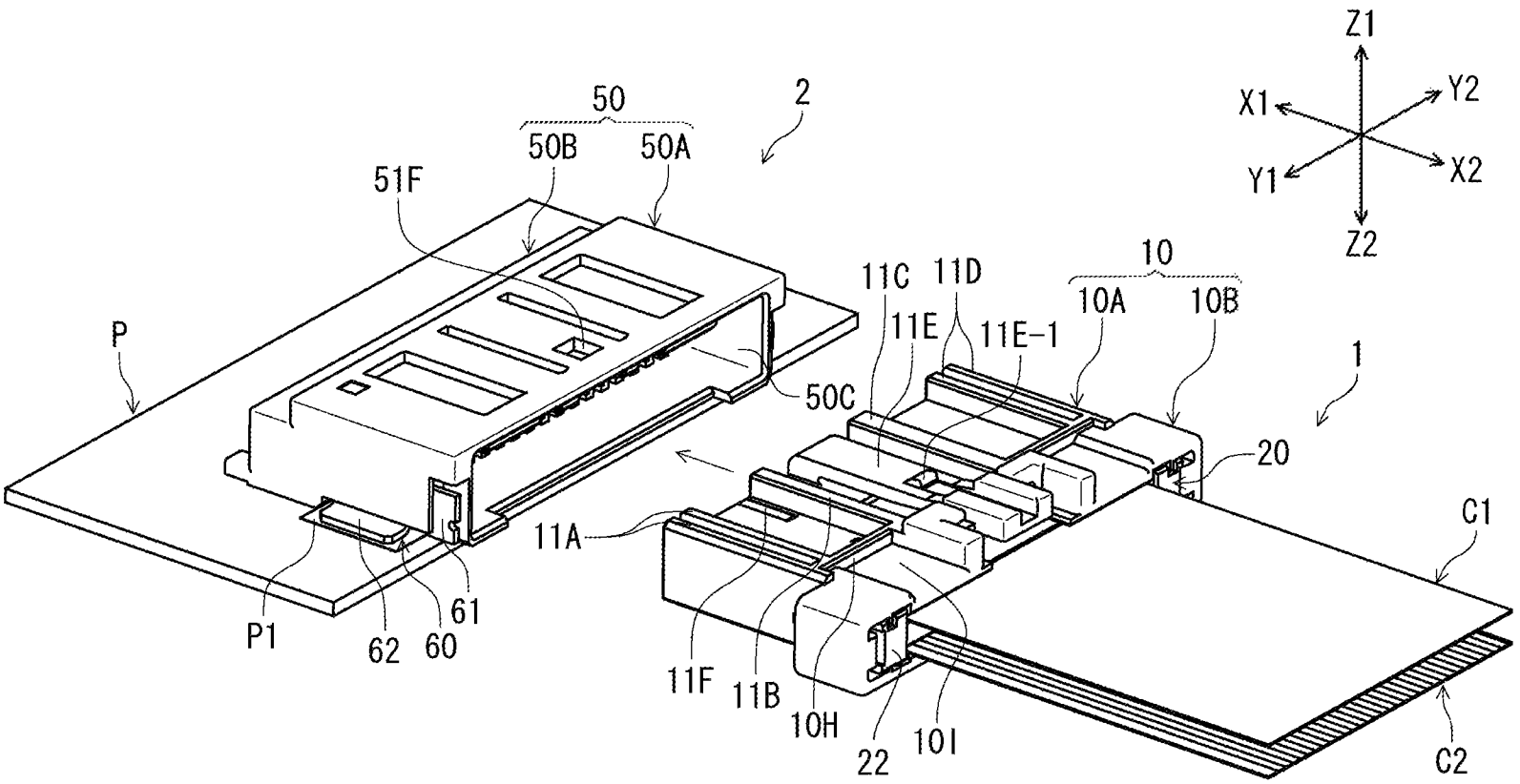
FIG. 1 illustrates a posterior perspective view of an electrical connector assembly according to an embodiment of the present invention, illustrated before connector mating.
Figure 2:
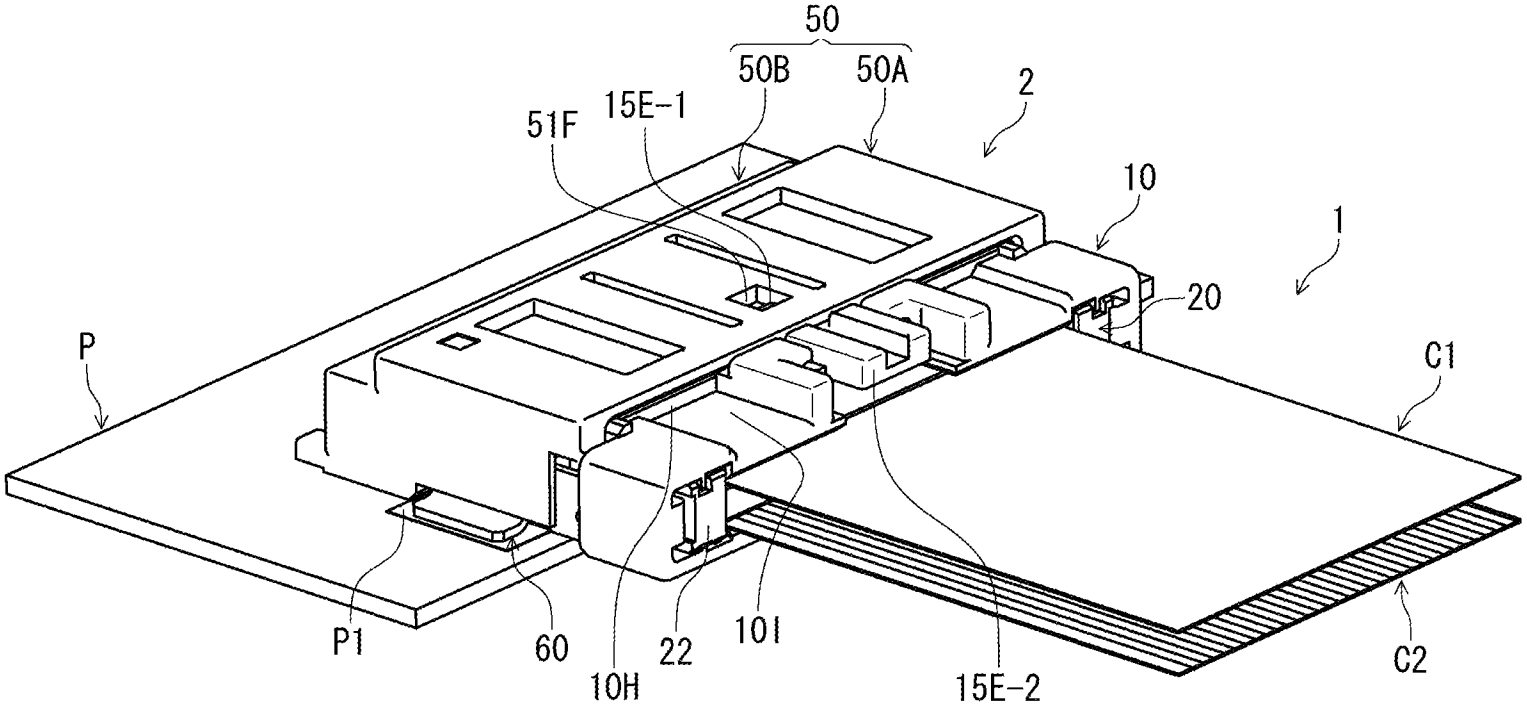
FIG. 2 illustrates a posterior perspective view of the electrical connector assembly of FIG. 1, illustrated after connector mating.
Figure 3:
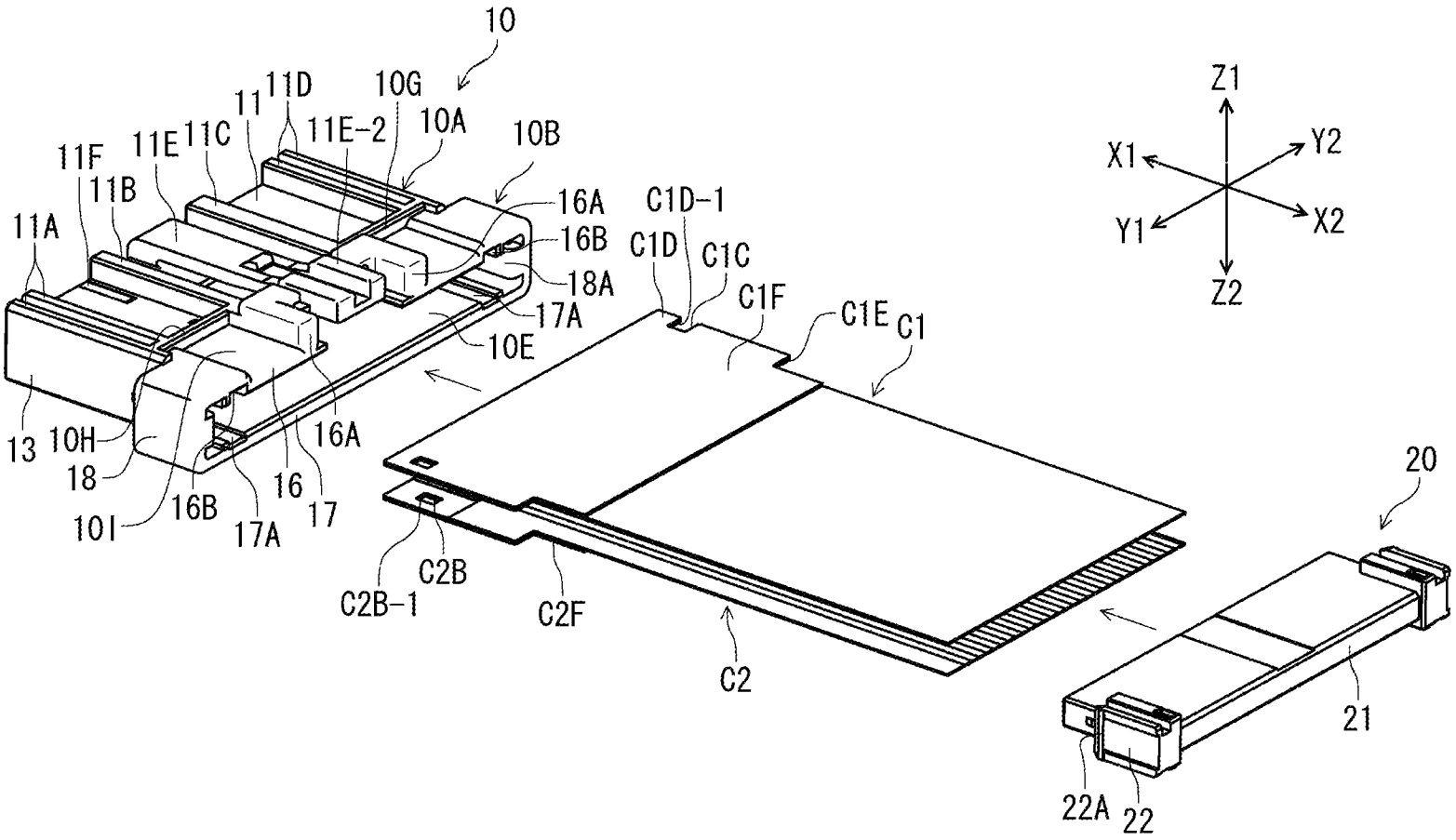
FIG. 3 illustrates an exploded perspective view of the components of the electrical connector with flat-type conductors used in the electrical connector assembly of FIG. 1.

FIG. 1 and FIG. 2 are perspective views of the electrical connector assembly according to the present embodiment, illustrated before connector mating in FIG. 1 and after connector mating in FIG. 2. FIG. 3 is an exploded perspective view of the components of the electrical connector with flat-type conductors used in the electrical connector assembly of FIG. 1. In the present embodiment, the electrical connector assembly has an electrical connector with flat-type conductors 1 (referred to as "connector 1" below) and a counterpart electrical connector (referred to as "counterpart connector 2" below), which are removably connected such that the forward-backward direction (X-direction) is the direction of connector insertion and removal. The connector 1 is mated with the counterpart connector 2 mounted to the mounting face of a circuit board P in the forward direction (X1 direction), and is matingly connected to the counterpart connector 2.

The connector 1 has two flat-type conductors C1, C2 extending in the forward-backward direction, a housing 10 holding the front end sections of the flat-type conductors C1, C2, and a retainer 20 attached to the housing 10 and capable of supporting the front end sections of the flat-type conductors C1, C2 from the rear. The housing 10 and the retainer 20 are made of resin or another electrically insulating material.

The two flat-type conductors C1, C2 have a strip-like configuration extending in the forward-backward direction (X-direction) such that the connector width direction (Y-direction) is the strip width direction and have their faces opposed in a face-to-face relationship at locations spaced apart from each other in the up-down direction (Z-direction). When referring to the two flat-type conductors C1, C2 in the present embodiment, the flat-type conductor C1 positioned above (on side Z1) is called "upper flat-type conductor C1," and the flat-type conductor C2 positioned below (on side Z2) is called "lower flat-type conductor C2," with both connectors referred to as "flat-type conductors C1, C2" if there is no need to distinguish between the two.

Figure 4B:
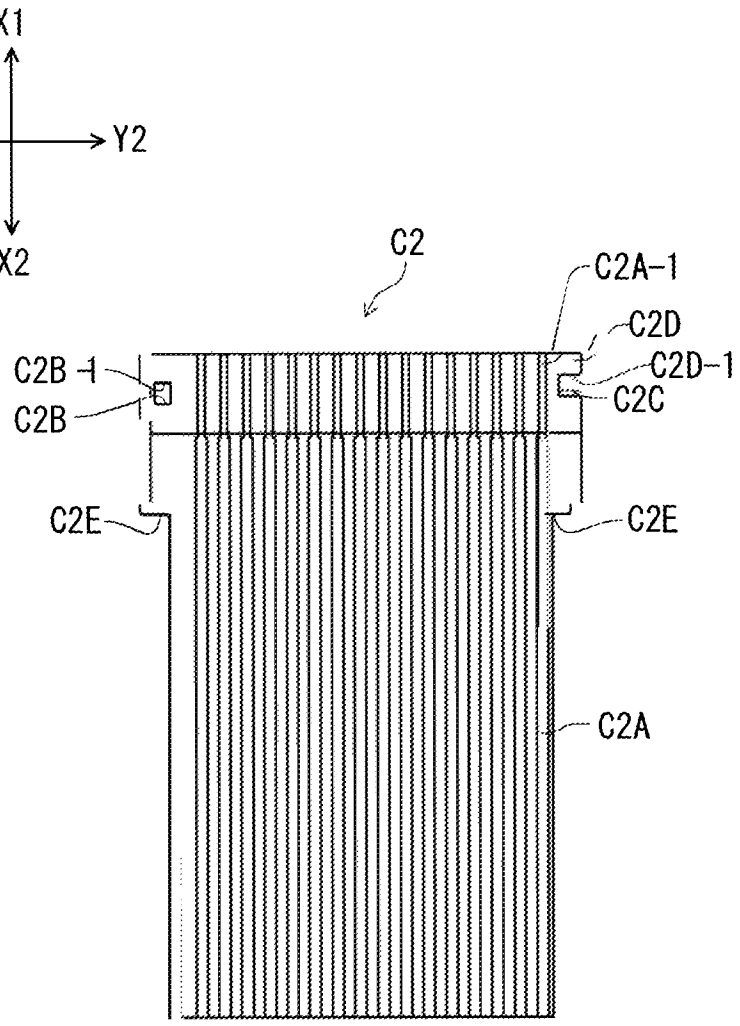
FIG. 4 (A) is a plan view of the upper flat-type conductor, and FIG. 4 (B) is a plan view of the lower flat-type conductor.
Figure 4A:
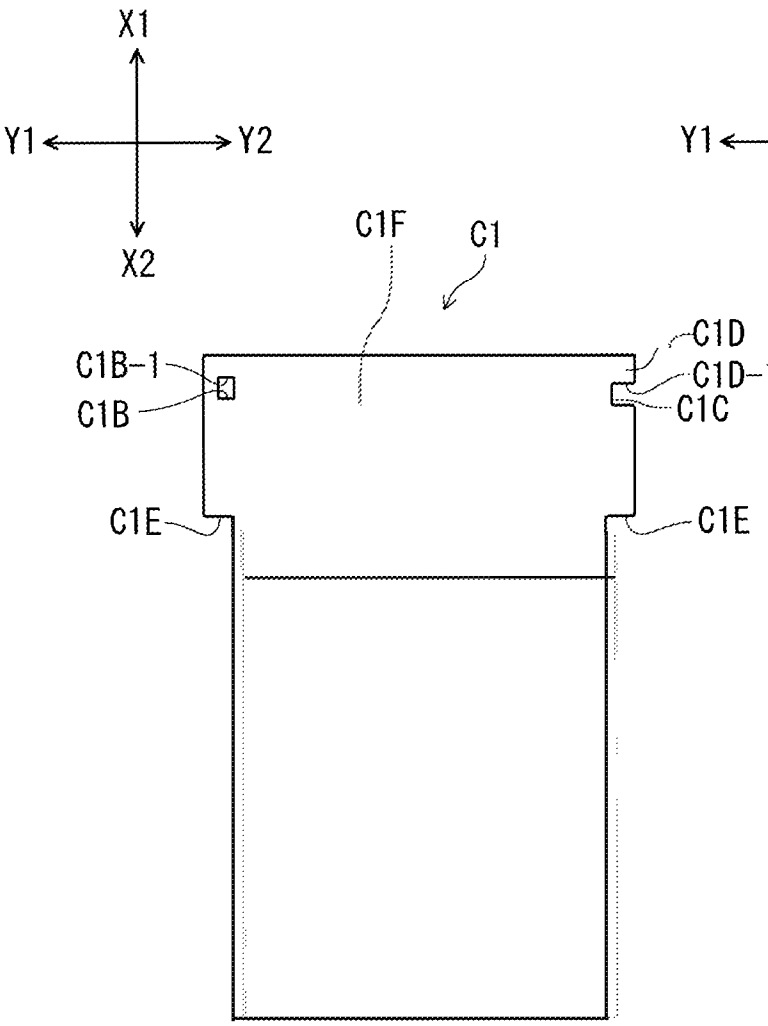

FIG. 4 (A) is a plan view of the upper flat-type conductor C1, and FIG. 4 (B) is a plan view of the lower flat-type conductor C2. On one of its faces, namely, on the bottom face, the upper flat-type conductor C1 has a plurality of circuits C1A extending in the forward-backward direction (see FIG. 11 (A)) that are arranged in the strip width direction (Y-direction) of the upper flat-type conductor C1. The circuits C1A are exposed on the bottom face and extend to the front end of the flat-type conductor C1 (end on side X1). The sections at the front end of the circuits C1A constitute upper contact portions C1A-1 (see FIG. 11 (A)) intended for contacting the hereinafter-described upper counterpart terminals 30 of the counterpart connector 2. In addition, the front end section of the upper flat-type conductor C1, which is inserted into the hereinafter-described upper insertion space 10F of the housing 10, is made wider in the strip width direction than the other sections.

As can be seen in FIG. 3 and FIG. 4 (A), an aperture C1B extending in the thickness direction (Z-direction) of the upper flat-type conductor C1 is formed in a lateral edge portion located proximate to side Y1 of the upper flat-type conductor C1 in the strip width direction (Y-direction) of the upper flat-type conductor C1, and the front end edge of said aperture C1B serves as an engageable portion C1B-1 engaging the hereinafter-described upper engagement protrusion 15A-1 of the housing 10 (see FIG. 6). In addition, a notched portion C1C is formed in a lateral edge portion located on side Y2, and an ear portion C1D, which protrudes outwardly in the strip width direction, is formed at a location in front of said notched portion C1C. The rear end edge of the ear portion C1D serves as an engageable portion C1D-1 that engages with the hereinafter-described upper engagement protrusion 15A-1 of the housing 10. The rear end edges on the opposite sides of the front end section of the upper flat-type conductor C1 in the strip width direction serve as lateral supported portions C1E rearwardly supported by the hereinafter-described support wall portions 22 of the retainer 20. In addition, a reinforcing plate C1F is adhered to the other face, that is, the top face, of the front end section of the upper flat-type conductor C1 for the purpose of reinforcing the front end section.

The lower flat-type conductor C2 has a shape obtained by transposing the aperture C1B and the notched portion C1C in the upper flat-type conductor C1 in the strip width direction (Y-direction) (FIGS. 4 (A) and 4 (B)). In other words, when the lower flat-type conductor C2 is placed in an orientation wherein one of the faces, namely, the face on which the circuits C2A are formed, is the top face, the aperture C2B is positioned on the same side as the aperture C1B of the upper flat-type conductor C1, that is, on side Y1, and the notched portion C2C is positioned on the same side as the notched portion C1C of the upper flat-type conductor C1, that is, on side Y2 (see FIGS. 4 (A) and 4 (B)). The lower flat-type conductor C2 is similar to the upper flat-type conductor C1 in that the sections at the front ends of the circuits C2A serve as lower contact portions C2A-1, the front end edge of the aperture C2B serves as an engageable portion C2B-1, the rear end edge of the ear portion C2D located forwardly of the notched portion C2C serves as an engageable portion C2D-1, the rear end edges of the opposite lateral edge portions in the front end section of the lower flat-type conductor C2 serve as lateral supported portions C2E, and a reinforcing plate C2F is adhered to the other face, that is, the bottom face, of the front end section of the lower flat-type conductor C2.

Although in the present embodiment the aperture C1B and notched portion C1C of the upper flat-type conductor C1 are formed in the same shape as the aperture C2B and notched portion C2C of the lower flat-type conductor C2, they are positioned with an offset relative to the aperture C2B and notched portion C2C in the forward-backward direction. Specifically, as can be seen by comparing FIG. 4 (A) and FIG. 4 (B), the aperture C1B of the upper flat-type conductor C1 is positioned slightly forward (on side X1) of the aperture C2B of the lower flat-type conductor C2, and the notched portion C1C of the upper flat-type conductor C1 is positioned slightly rearward (on side X2) of the notched portion C2C of the lower flat-type conductor C2. Varying the locations of the notched portions and apertures in the forward-backward direction in this manner makes it possible to prevent inadvertently swapping the upper flat-type conductor C1 and the lower flat-type conductor C2 when attaching to the housing 10.

As can be seen in FIG. 3, the housing 10, which is of a substantially rectangular parallelepiped-like exterior configuration whose longitudinal direction is the connector width direction (Y-direction), along with having a mating portion 10A mating with the hereinafter-described counterpart housing 50 largely within the front half (section on side X1), has a retainer installation portion 10B, into which the retainer 20 is installed from the rear, largely within the rear half (section on side X2). In addition, a dividing wall 10C extending in the connector width direction (see FIG. 7) is provided within the interior space of the housing 10 at an intermediate location of the mating portion 10A in the forward-backward direction (X-direction), such that the interior space is divided by the dividing wall 10C in the forward-backward direction. Specifically, the interior space is divided into a front receiving space 10D formed forwardly of the dividing wall 10C and a rear receiving space 10E formed rearwardly of the dividing wall 10C. The front receiving space 10D is a space intended for receiving the hereinafter-described nesting portion 54 of the counterpart connector 2 from the front when the connectors are in a mated state. The rear receiving space 10E is a space intended for receiving the retainer 20 from the rear.

In addition, a space that expands as it extends in the forward-backward direction along the interior surface (bottom face) of the top walls (front top wall 11 and rear top wall 16 discussed below) of the housing 10 is formed as an upper insertion space 10F within the interior space of the housing 10 (see FIG. 6). The upper insertion space 10F holds the front end section of the upper flat-type conductor C1 inserted from the rear (see FIG. 6). Once the front end section of the upper flat-type conductor C1 is held within the upper insertion space 10F, the bottom face of the top wall of the housing 10 is brought into surface contact or close proximity with the top face of the upper flat-type conductor C1 and is enabled to support the top face of the upper flat-type conductor C1.

In addition, a space that expands as it extends in the forward-backward direction along the interior surface (top face) of the bottom walls (front bottom wall 12 and rear bottom wall 17 discussed below) of the housing 10 is formed as a lower insertion space 10G within the interior space of the housing 10 (see FIG. 6). The lower insertion space 10G holds the front end section of the lower flat-type conductor C2 inserted from the rear (see FIG. 6). Once the front end section of the lower flat-type conductor C2 is held within the lower insertion space 10G, the top face of the bottom wall of the housing 10 is brought into surface contact or close proximity with the bottom face of the lower flat-type conductor C2 and is enabled to support the bottom face of the lower flat-type conductor C2.

In this manner, in the present embodiment, the top wall and bottom wall of the housing 10 are enabled to support the respective corresponding front end portions of the flat-type conductors C1, C2. Therefore, when the connectors are in a mated state and the contact portions C1A-1, C2A-1 of the flat-type conductors C1, C2 are subject to pressure from the counterpart contact portions 32A, 33A, 42A, 43A of the hereinafter-described counterpart terminals 30, 40, the front end portions of the flat-type conductors C1, C2 are supported by the top and bottom walls of the housing 10 and resilient deformation of said front end portions is minimized, thereby making it possible to ensure a sufficiently high contact pressure between the contact portions C1A-1, C2A-1 and the counterpart contact portions 32A, 33A, 42A, 43A. Therefore, there is no longer need to increase the thickness of the front end portions of the flat-type conductors C1, C2 and, consequently, an increase in the size of the connector 1 in the up-down direction, that is, in the thickness direction of the flat-type conductors C1, C2, can be avoided.

Figure 5:
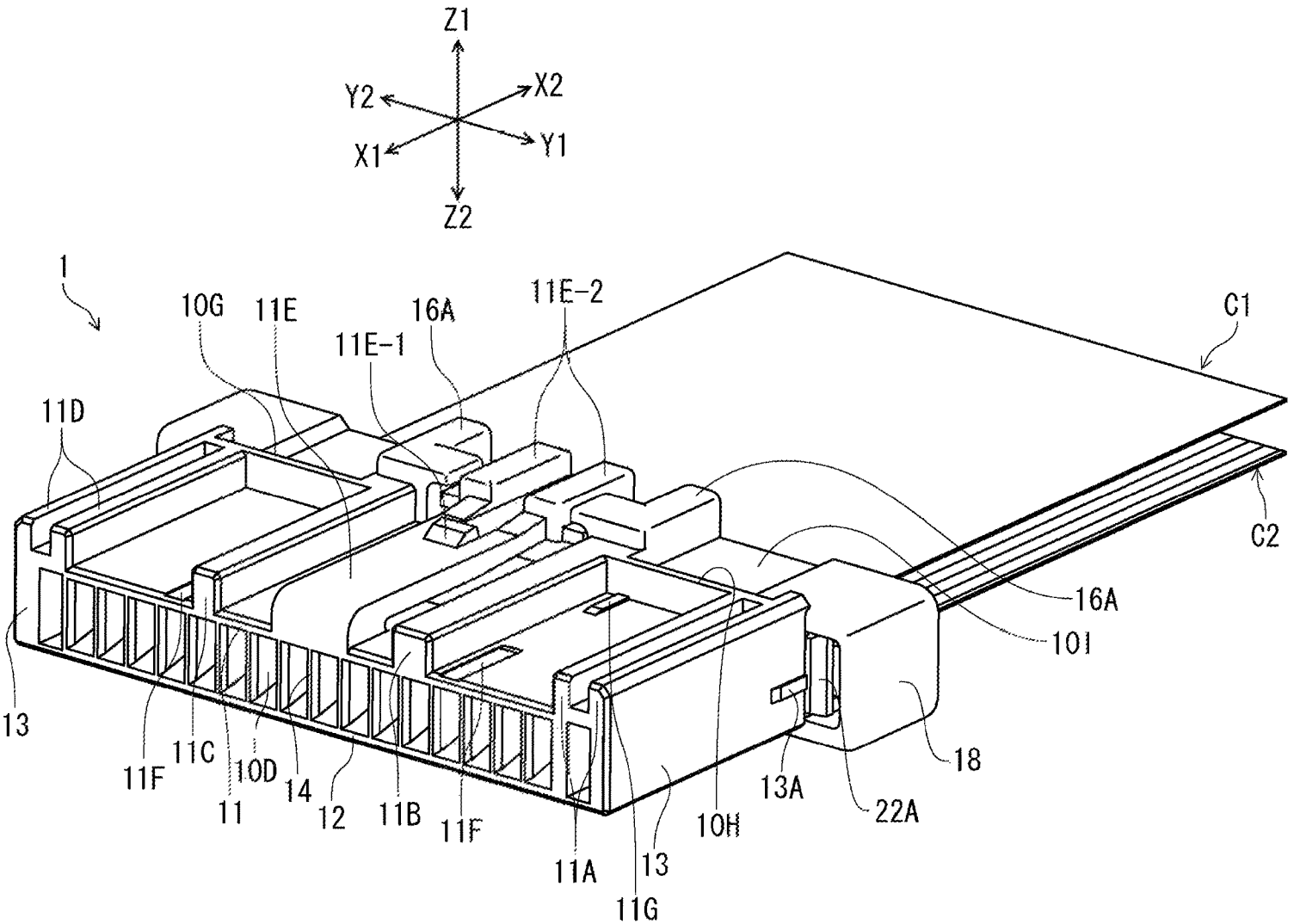
FIG. 5 illustrates an anterior perspective view of the electrical connector with flat-type conductors used in the electrical connector assembly of FIG. 1.

As can be seen in FIG. 5, the mating portion 10A has a front top wall 11 and a front bottom wall 12 serving as mating walls that extend in the connector width direction and that are opposed in the up-down direction, a pair of front side walls 13 that extend in the up-down direction at the opposite ends in the connector width direction and that couple the front top wall 11 to the front bottom wall 12, and a plurality of partition walls 14 that extend in the up-down direction in the intermediate region in the connector width direction and that couple the front top wall 11 to the front bottom wall 12.

Protruding walls 11A-11D, which protrude from the top face of the front top wall 11 while extending in the forward-backward direction, are formed on the front top wall 11 at two locations in the intermediate area as well as at the opposite side edges in the connector width direction. Specifically, as can be seen in FIG. 3 and FIG. 5, the protruding walls 11A-11D include a first protruding wall 11A, a second protruding wall 11B, a third protruding wall 11C, and a fourth protruding wall 11D arranged successively in a spaced relationship from side Y1 to side Y2. The first protruding wall 11A and the fourth protruding wall 11D, which are positioned at the opposite side edges of the front top wall 11 in the connector width direction, are split in the connector width direction by forwardly and upwardly open grooves extending in the forward-backward direction. The second protruding wall 11B and the third protruding wall 11C are positioned in the intermediate area of the front top wall 11 in the connector width direction, with the second protruding wall 11B made slightly wider than the third protruding wall 11C.

In addition, a cantilevered locking arm portion 11E extending rearwardly from the front end of the top face of the front top wall 11 to the rear end of the housing 10 is formed at the center of the front top wall 11 in the connector width direction, i.e., between the second protruding wall 11B and the third protruding wall 11C. The locking arm portion 11E, which is positioned to extend in a spaced relationship relative to the top face of the front top wall 11, is enabled to be resiliently displaced in the up-down direction. In addition, an upwardly protruding locking protrusion 11E-1 is formed at an intermediate location of the locking arm portion 11E in the forward-backward direction, thereby enabling locking engagement with the hereinafter-described locking aperture 51F of the counterpart connector 2 with the help of said locking protrusion 11E-1. In addition, the rear end portion, i.e., the free end portion, of the locking arm portion 11E-1 serves as an operative portion 11E-2 subject to pressing operations (unlocking operations) applied from above for the purpose of unlocking from the counterpart connector 2.

A top groove portion 11F and a top ridge portion 11G extending in the forward-backward direction are formed on the top face of the front top wall 11 at locations proximate to the second protruding wall 11B outwardly of the second protruding wall 11B in the connector width direction as well as at locations proximate to the third protruding wall 11C outwardly of the third protruding wall 11C in the connector width direction. As can be seen in FIG. 5, the top groove portions 11F are formed proximate to the front end of the front top wall 11 by recessing the top face of the front top wall 11. As described hereinafter, the top groove portions 11F permit anterior entry of the upper support protrusions 51E of the counterpart connector 2. The top ridge portions 11G are formed protruding from the top face of the front top wall 11 at the rear end of the front top wall 11. As described hereinafter, the top ridge portions 11G abut the interior surface (bottom face) of the counterpart top wall 51 of the counterpart connector 2.

Figure 12A:
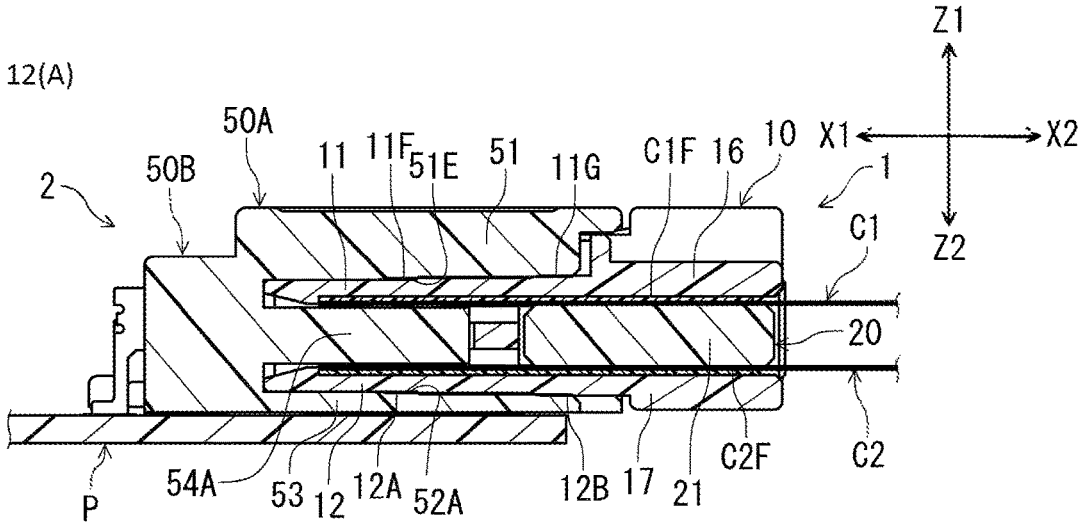
FIG. 12 (A) is a cross-sectional view of the electrical connector assembly of FIG. 2 in a plane perpendicular to the connector width direction, which shows a cross-section taken across the locations of the upper groove portion of the housing and the upper support protrusion of the counterpart housing, FIG. 12 (B) is a partial enlarged view of FIG. 12 (A), and FIG. 12 (C) is a cross-sectional view of the electrical connector assembly of FIG. 2 in a plane perpendicular to the forward-backward direction, which shows a partial enlargement of a cross-section taken across the locations of the upper groove portion of the housing and the upper support protrusion of the counterpart housing.
Figure 12B:
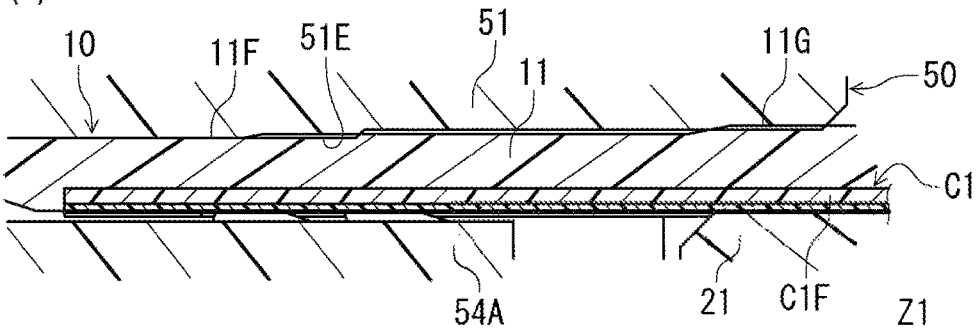
Figure 12C:
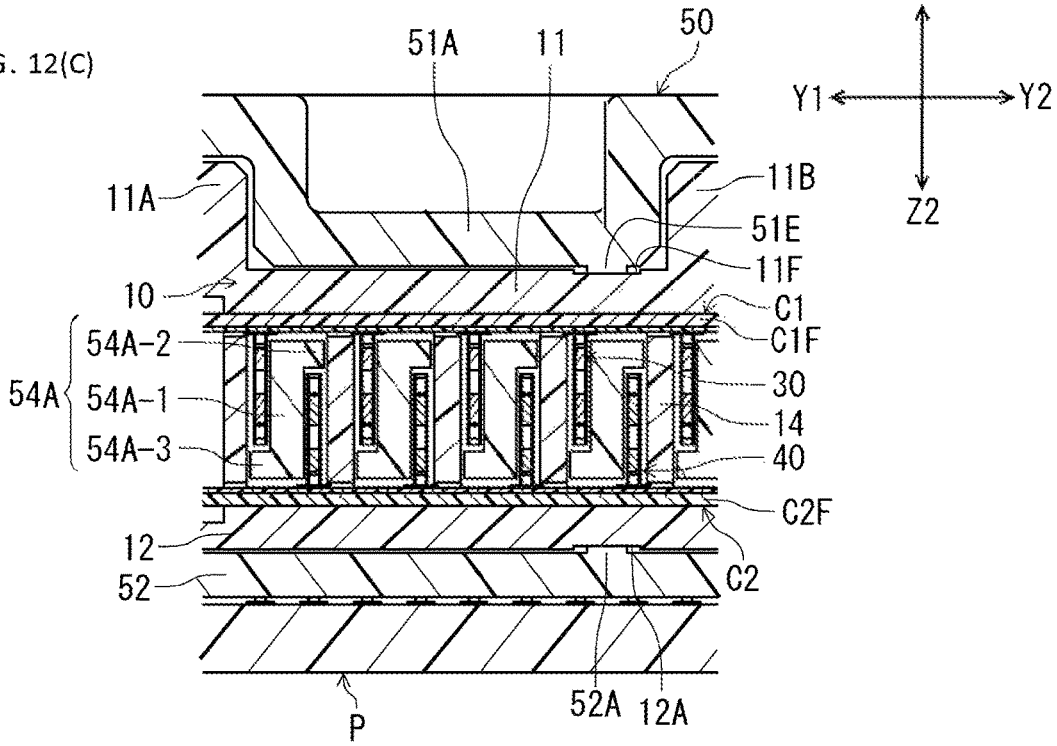

Bottom groove portions 12A (see FIG. 12 (A, C)) and bottom ridge portions 12B (see FIG. 12 (A)) of the same shape as the top groove portions 11F and the top ridge portions 11G are formed on the bottom face of the front bottom wall 12 in the same positions as the top groove portions 11F and the top ridge portions 11G of the front top wall 11 when viewed in the up-down direction.

As can be seen in FIG. 5, lateral protrusions 13A, which protrude from the side faces (exterior surfaces) of the front side walls 13 proximate the rear ends of said front side walls 13 and extend in the forward-backward direction, are formed on the said front side walls 13. As described hereinafter, the lateral protrusions 13A abut the interior surfaces of the counterpart side walls 53 of the counterpart connector 2.

As can be seen in FIG. 5, an array of partition walls 14 is formed at regular intervals in the connector width direction, with the front receiving space 10D split by these partition walls 14 in the connector width direction. As can be seen in FIG. 7, the partition walls 14 at the outermost ends in the connector width direction are at the same positions as the opposite ends of dividing wall 10C. The partition walls 14 at the outermost ends and dividing wall 10C are positioned in a spaced relationship relative to the interior surfaces of the front side walls 13 in the connector width direction, and engaging arm portions 15 engageable with the flat-type conductors C1, C2 are provided extending in the forward-backward direction through the gaps that constitute the spaces. As can be seen in FIG. 6, the engaging arm portions 15 have an upper engaging arm portion 15A engageable with the upper flat-type conductor C1 and a lower engaging arm portion 15B engageable with the lower flat-type conductor C2. The engaging arm portions 15, which have their rear end portions coupled to the exterior surfaces of the dividing wall 10C and the interior surfaces of the front side walls 13 (see FIG. 7), are of a cantilevered configuration extending forwardly from the rear end portion and are resiliently deformable in the up-down direction. As can be seen in FIG. 6, the upper engaging arm portion 15A is made slightly longer than the lower engaging arm portion 15B, and the front end portion (free end portion) of the upper engaging arm portion 15A is positioned forwardly of the front end portion (free end portion) of the lower engaging arm portion 15B.

Upwardly protruding upper engagement protrusions 15A-1 engageable with the engageable portions C1B-1, C1D-1 of the upper flat-type conductor C1 are formed in the front end portions (free end portions) of the upper engaging arm portions 15A. The front end faces of the upper engagement protrusions 15A-1, which constitute flat engaging faces perpendicular to the forward-backward direction, prevent inadvertent decoupling of the upper flat-type conductor C1 by engaging the engageable portions C1B-1, C1D-1 of the upper flat-type conductor C1 with these engaging faces from the rear. In addition, the rear end faces of the upper engagement protrusions 15A-1 have inclined faces that are upwardly sloped toward the front. When the upper flat-type conductor C1 is attached by insertion into the upper insertion space 10F of the housing 10 from the rear, the front end of the upper flat-type conductor C1 abuts these inclined faces, which causes the upper engaging arm portions 15A to be resiliently deformed downward and permits smooth forward insertion of the upper flat-type conductor C1.

Figure 6:
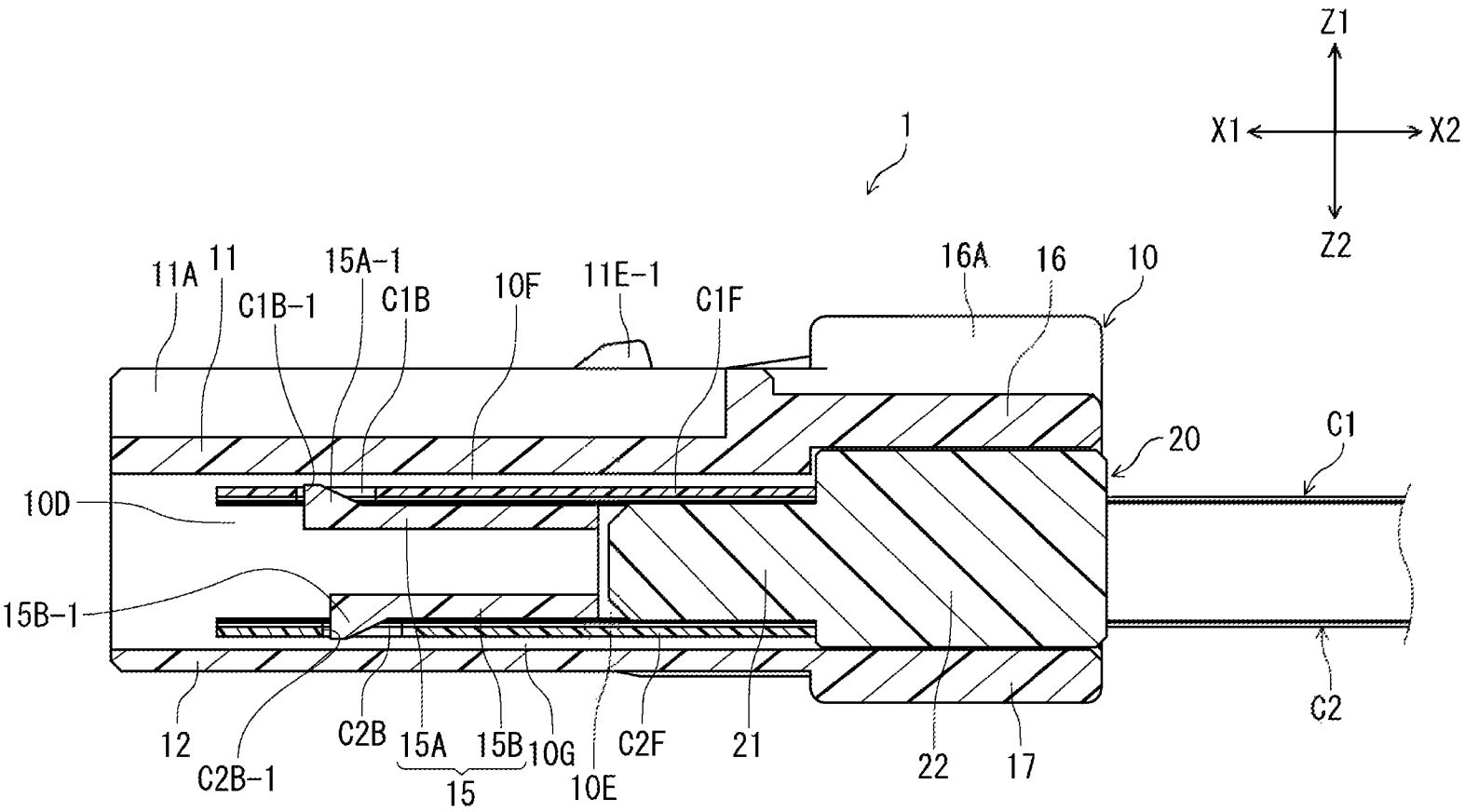
FIG. 6 illustrates a cross-sectional view of the electrical connector with flat-type conductors of FIG. 1 in a plane perpendicular to the connector width direction, which shows a cross-section taken across the locations of the engaging arm portions of the housing and the engageable portions of the flat-type conductors.
Figure 7:
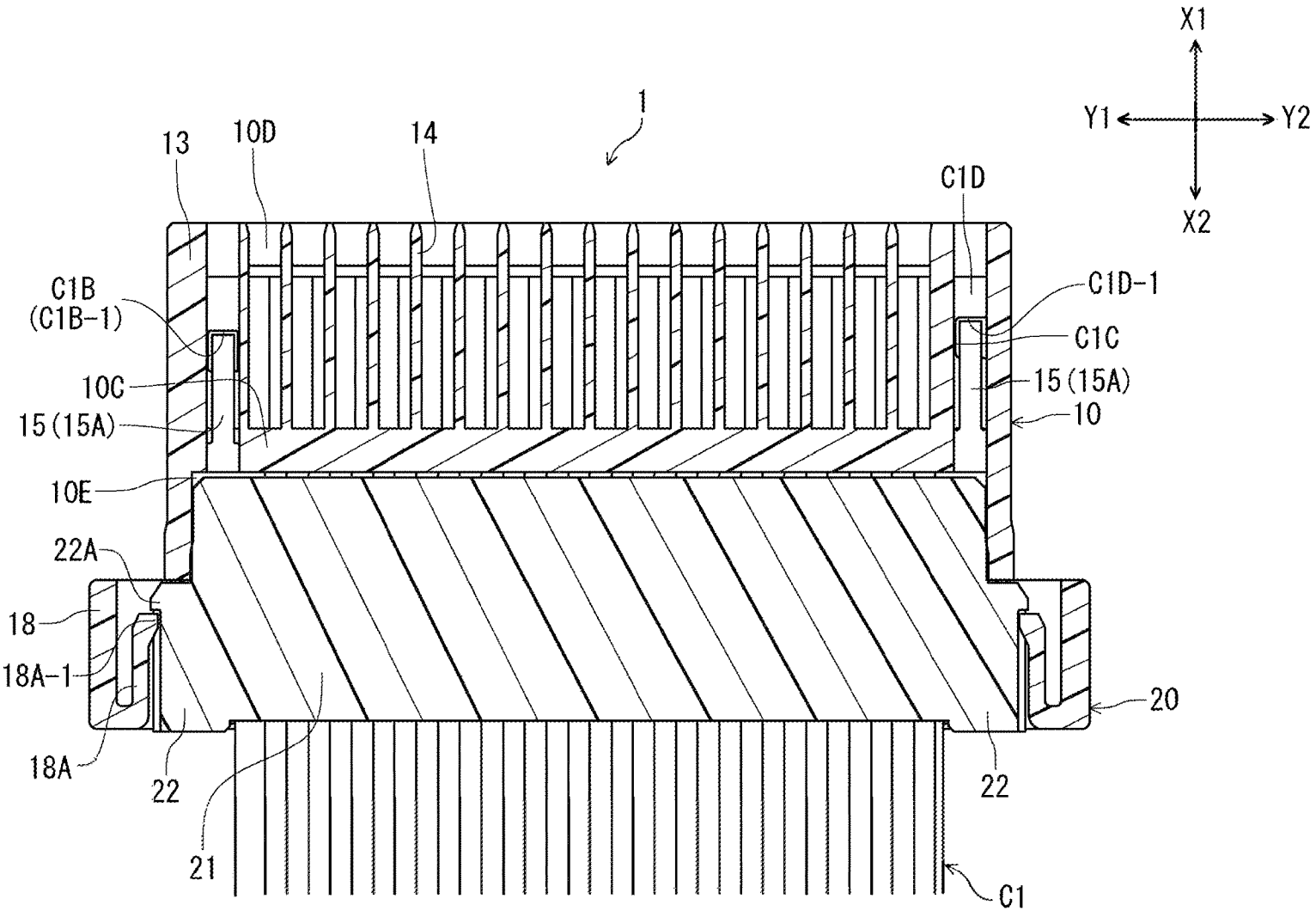
FIG. 7 illustrates a cross-sectional view of the electrical connector with flat-type conductors of FIG. 1, which is perpendicular to the up-down direction and shows a cross-section taken across the locations of the lateral arm portions of the housing and the lateral engageable portions of the retainer.

As can be seen in FIG. 6, downwardly protruding lower engagement protrusions 15B-1 engageable with the engageable portions C2B-1, C2D-1 of the lower flat-type conductor C2 are formed in the front end portions (free end portions) of the lower engaging arm portions 15B. The lower engagement protrusions 15B-1 are shaped by inverting the shape of the previously discussed upper engagement protrusions 15A-1 and have the same function as the upper engagement protrusions 15A-1.

As can be seen in FIG. 3, the retainer installation portion 10B has a rear top wall 16 and a rear bottom wall 17 that extend in the connector width direction and are opposed in the up-down direction, and a pair of rear side walls 18, which extend in the up-down direction at the opposite ends in the connector width direction and couple the rear top wall 16 to the rear bottom wall 17. The retainer installation portion 10B is made larger than the mating portion 10A in the connector width direction, with the rear side walls 18 positioned outwardly of the front side walls 13 in the connector width direction.

Limiting walls 16A, which protrude from the top face of the rear top wall 16, are formed on the rear top wall 16 on the opposite sides of the operative portion 11E-2 of the locking arm portion 11E at locations proximate the center in the connector width direction. The limiting walls 16A, which are positioned so as to permit abutment against the operative portion 11E-2 in the connector width direction, limit excessive resilient deformation of the locking arm portion 11E in the connector width direction. Rear top groove portions 16B, which are recessed from the bottom face of the rear top wall 16 and extend in the forward-backward direction, are formed in the rear top wall 16 at locations proximate the lateral edges in the connector width direction. The rear top groove portions 16B are open toward the rear and permit posterior entry of the top portions of the hereinafter-described support wall portions 22 of the retainer 20.

In addition, rear bottom groove portions 17A are formed in the rear bottom wall 17 in the same positions as the rear top groove portions 16B when viewed in the up-down direction. The rear bottom groove portions 17A, which are recessed from the top face of the rear bottom wall 17 and extend in the forward-backward direction while being open toward the rear, permit posterior entry of the bottom portions of the hereinafter-described support wall portions 22 of the retainer 20.

As can be seen in FIG. 7, lateral arm portions 18A, which extend from the interior surface of the rear end portions of the rear side walls 18 forwardly along said interior surface, are formed on the rear side walls 18. The lateral arm portions 18A have a cantilevered configuration, in which the front end portions are free end portions, and are resiliently deformable in the connector width direction. Lateral engagement protrusions 18A-1, which protrude inwardly in the connector width direction, are formed in the front end portions of the lateral arm portions 18A. The lateral engagement protrusions 18A-1 are enabled for rearward engagement with the hereinafter-described lateral engageable portions 22A of the retainer 20 using the front end faces (flat faces perpendicular to the forward-backward direction) and prevent inadvertent decoupling of the retainer 20.

As can be seen in FIG. 3, in the present embodiment, anti-drip walls 10H, which protrude from the top face of the housing 10 outwardly of the limiting walls 16A in the connector width direction, are formed at the location of the boundary between the mating portion 10A and the retainer installation portion 10B in the forward-backward direction. As can be seen in FIG. 2, these anti-drip walls 10H are positioned to seal the gaps that are formed between the front top wall 11 of the connector 1 and the counterpart top wall 51 of the counterpart connector 2 when the connectors are in a mated state. Sealing the gaps in this manner with the anti-drip walls 10H prevents water droplets generated as a result of dew condensation outside the connector from penetrating the interior of the counterpart connector 2.

As can be seen in FIGS. 1 to 3, in the present embodiment, rearwardly open rear recessed portions 10I are formed at the rear of the anti-drip walls 10H. Therefore, when the housing 10 is fabricated, the anti-drip walls 10H can be formed simply by disposing a mold (not shown) from the rear, molding the housing 10, and then rearwardly retracting said mold. In other words, there is no need to use a plurality of molds to form the anti-drip walls 10H, and the shape of the mold can be simplified.

As can be seen in FIG. 3, the retainer 20 has a solid central plate portion 21 of a substantially rectangular parallelepiped-like exterior shape whose longitudinal direction is the connector width direction, and support wall portions 22 formed at the opposite ends of the central plate portion 21 in the connector width direction. The support wall portions 22, which are in the same position as the lateral supported portions C1E, C2E of the flat-type conductors C1, C2 in the connector width direction, are formed within a range comprising the flat-type conductors C1, C2 in the up-down direction. Once the retainer 20 has been attached to the housing 10, the support wall portions 22 are positioned such that the front end faces of said support wall portions 22 (flat faces perpendicular to the forward-backward direction) are placed in close proximity to the lateral supported portions C1E, C2E of the flat-type conductors C1, C2 from the rear. Consequently, the support wall portions 22 are enabled to support the lateral supported portions C1E, C2E of the flat-type conductors C1, C2 from the rear.

As can be seen in FIG. 3, claw-shaped lateral engageable portions 22A, which protrude from the lateral exterior surfaces of the support wall portions 22 (surfaces positioned outwardly in the connector width direction) while extending in the up-down direction, are formed in the front end portions of the support wall portions 22. As can be seen in FIG. 7, when the retainer 20 is attached to the housing 10, the lateral engagement protrusions 18A-1 of the housing 10 are positioned rearwardly of the lateral engageable portions 22A so as to permit engagement with the lateral engageable portions 22A. In other words, in the present embodiment, the lateral engagement protrusions 18A-1 of the housing 10 are enabled to engage the lateral engageable portions 22A of the retainer 20 from the rear while the support wall portions 22 of the retainer 20 are enabled to support the lateral supported portions C1E, C2E of the flat-type conductors C1, C2 from the rear. In other words, the retainer 20 is enabled to support the flat-type conductors C1, C2 in conjunction with the housing 10.

The connector 1 is assembled in accordance with the following procedure. First, the flat-type conductors C1, C2 are attached to the housing 10 from the rear. Specifically, the front end section of the upper flat-type conductor C1 is inserted into the upper insertion space 10F of the housing 10 from the rear. In the process of insertion of the upper flat-type conductor C1, the front end of the upper flat-type conductor C1 abuts the upper engagement protrusions 15A-1 of the upper engaging arm portions 15A and causes the upper engaging arm portions 15A to be resiliently deformed downward, thereby permitting further insertion of the upper flat-type conductor C1. When the aperture C1B and notched portion C1C of the upper flat-type conductor C1 reach the locations of the respective corresponding upper engagement protrusions 15A-1, the upper engaging arm portions 15A return to the free state and the upper engagement protrusions 15A-1 enter the aperture C1B and the notched portion C1C respectively from below. Consequently, they are positioned so as to permit engagement with the engageable portions C1B-1, C1D-1 from the rear, and the upper flat-type conductor C1 becomes provisionally retained in place by the housing 10, which prevents inadvertent decoupling of the upper flat-type conductor C1.

In addition, the front end section of the lower flat-type conductor C2 is inserted into the lower insertion space 10G of the housing 10 from the rear. After inserting the lower flat-type conductor C2 while causing the lower engaging arm portions 15B to be resiliently deformed upward in accordance with the same procedure as the one previously described with regard to the upper flat-type conductor C1, the lower engagement protrusions 15B-1 of the lower engaging arm portions 15B, upon returning to the free state, are positioned so as to permit engagement with the engageable portions C2B-1, C2D-1 from the rear within the aperture C2B and the notched portion C2C, and the lower flat-type conductor C2 becomes provisionally retained in place by the housing 10, which prevents inadvertent decoupling of the lower flat-type conductor C2.

Next, after positioning the retainer 20 between the upper flat-type conductor C1 and the lower flat-type conductor C2, the retainer 20 is attached to the housing 10 by insertion into the rear receiving space 10E of the housing 10 from the rear. In the process of insertion of the retainer 20, the front ends of the lateral engageable portions 22A of the retainer 20 abut the lateral engagement protrusions 18A-1 of the lateral arm portions 18A and cause the lateral arm portions 18A to be resiliently deformed outwardly in the connector width direction, thereby permitting further insertion of the retainer 20. Once the lateral engageable portions 22A have passed the location of the lateral engagement protrusions 18A-1, the lateral arm portions 18A return to the free state, and the lateral engagement protrusions 18A-1 are positioned so as to permit engagement with the lateral engageable portions 22A from the rear (see FIG. 7), thereby preventing inadvertent decoupling of the retainer 20.

Once the retainer 20 is attached, the front end faces of the support wall portions 22 of the retainer 20 are positioned in close proximity to the lateral supported portions C1E, C2E of the flat-type conductors C1, C2 so as to permit abutment from the rear. As a result, the support wall portions 22 are enabled to support the lateral supported portions C1E, C2E of the flat-type conductors C1, C2 from the rear and inadvertent decoupling of the flat-type conductors C1, C2 is prevented. In addition, positioning the central plate portion 21 between the front end sections of the flat-type conductors C1, C2 in the up-down direction in a manner to support said front end sections in the up-down direction maintains proper orientation of the front end sections extending in the forward-backward direction. Attaching the retainer 20 to the housing 10 in this manner completes the assembly of the connector 1.

In the connector 1, the two flat-type conductors C1, C2 are disposed such that the contact portions C1A-1, C2A-1 are positioned on the respective interior side faces, with the front receiving space 10D formed between the pair of interior side faces. In other words, the contact portions C1A-1, C2A-1 of the two flat-type conductors C1, C2 are spaced apart by the dimensions of the front receiving space 10D in the up-down direction, that is, the thickness direction of the flat-type conductors C1 C2, which ensures a sufficiently large creepage distance between the two flat-type conductors C1, C2. In addition, when the connectors are in a mated state, the hereinafter-described nesting portion 54 of the counterpart connector 2 is nested within the front receiving space 10D of the connector 1, and the counterpart contact portions 32A, 33A, 42A 43A of the counterpart terminals 30, 40 discussed below, which are disposed in the nesting portion 54, are brought into contact with the contact portions C1A-1, C2A-1 on the interior side faces of the flat-type conductors C1, C2 under contact pressure. Therefore, the counterpart terminals 30, 40 are not located on the exterior side faces of the two flat-type conductors C1, C2 and the dimensions of the connector in the thickness direction of the flat-type conductors can be proportionately reduced in comparison with conventional connectors.

Figure 8:
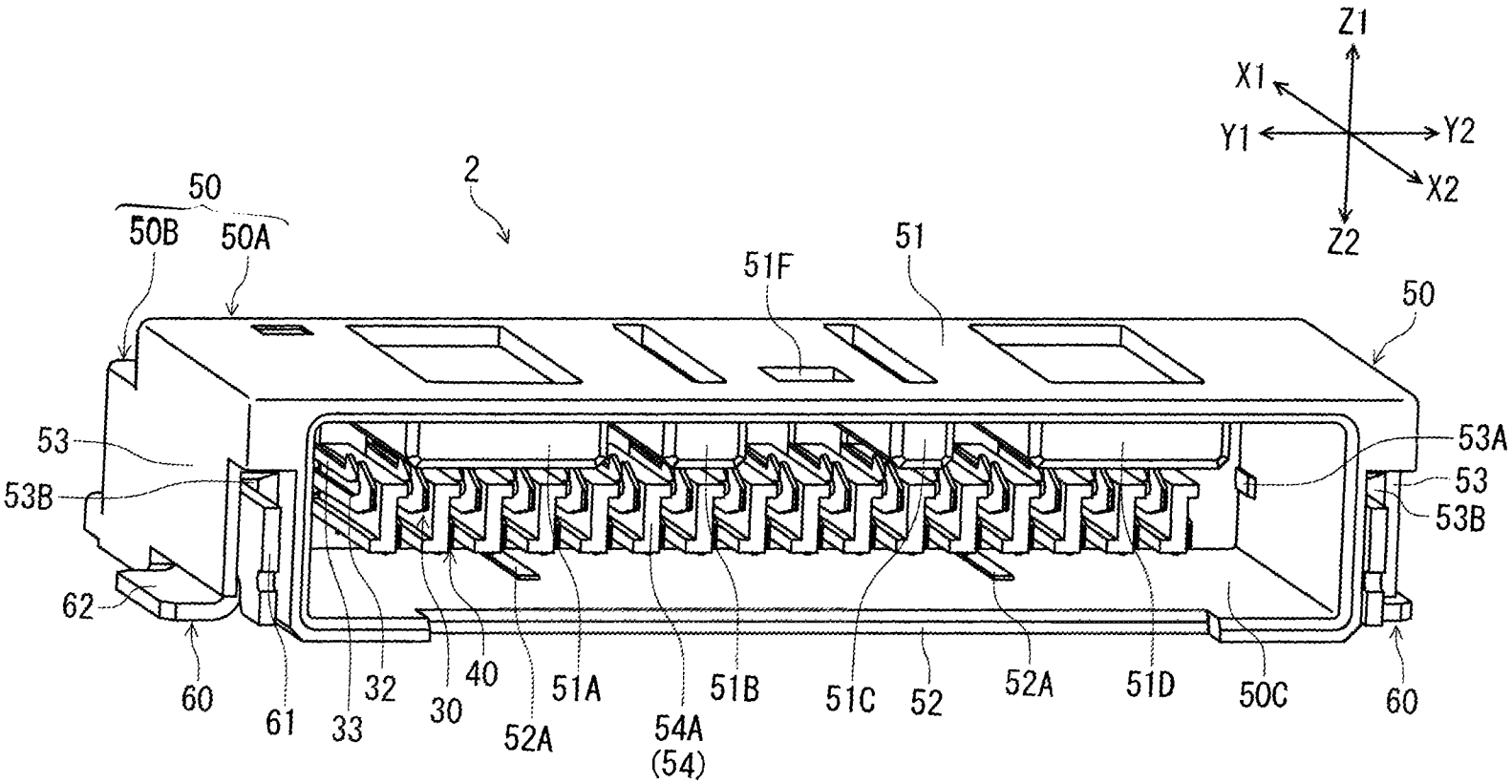
FIG. 8 illustrates a posterior perspective view of the counterpart electrical connector used in the electrical connector assembly of FIG. 1.

As can be seen in FIG. 8, the counterpart connector 2 has a plurality of counterpart terminals 30, 40 arranged in alignment with the plurality of contact portions C1A-1, C2A-1 of the flat-type conductors C1, C2 of the connector 1 in the connector width direction (Y-axis direction), a counterpart housing 50 retaining a plurality of counterpart terminals 30, 40 in place by way of press-fitting, and anchor fittings 60 press-fitted and retained in place within the counterpart housing 50 outside of the array range of the counterpart terminals 30, 40 in the connector width direction.

Figure 9B:
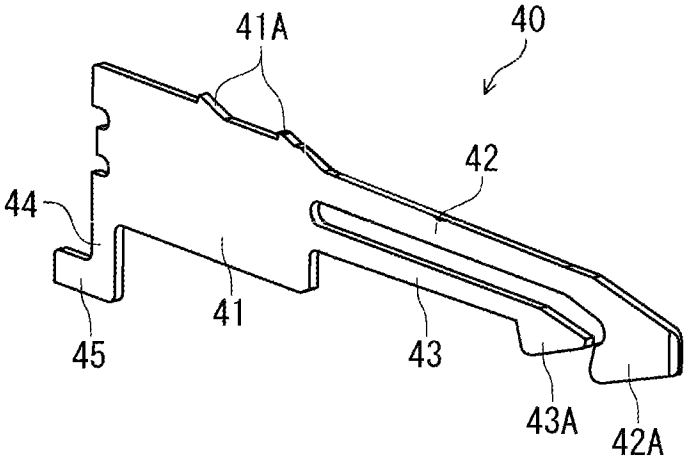
FIG. 9 (A) is a posterior perspective view of an upper counterpart terminal, and FIG. 9 (B) is a posterior perspective view of a lower counterpart terminal.
Figure 9A:
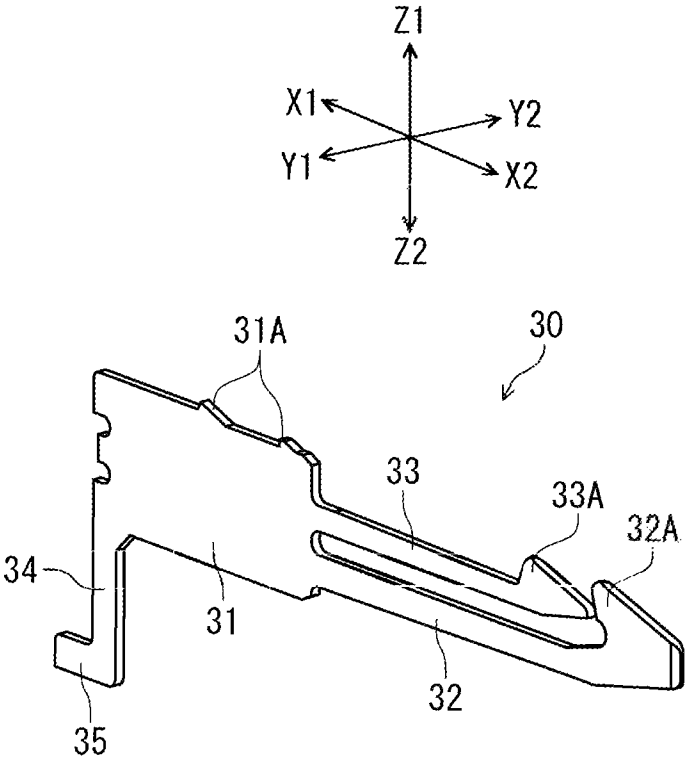

The plurality of counterpart terminals 30, 40 have one set of counterpart terminals corresponding to the upper flat-type conductor C1 of the connector 1 and another set of counterpart terminals corresponding to the lower flat-type conductor C2 of the connector 1. Specifically, said one set of counterpart terminals has a plurality of upper counterpart terminals 30 connectable to the upper flat-type conductor C1, and said other set of counterpart terminals has a plurality of lower counterpart terminals 40 connectable to the lower flat-type conductor C2. As can be seen in FIG. 9, the counterpart terminals 30, 40 are made by blanking out of sheet metal members in the through-thickness direction and have a planar configuration in which its major faces are kept flat. The upper counterpart terminals 30 and lower counterpart terminals 40 are arranged in an alternating manner such that the direction of the terminal array is the connector width direction, in an orientation wherein the through-thickness direction thereof coincides with the connector width direction (Y-axis direction).

In the present embodiment, the hereinafter-described arm portions 32, 33 of the upper counterpart terminals 30 and the hereinafter-described arm portions 42, 43 of the lower counterpart terminals 40 are configured to enter the front receiving space 10D of the connector 1, i.e., between the pair of interior side faces of the front end portions of the two flat-type conductors C1, C2 when the connectors are in a mated state. In other words, since the arm portions 32, 33, 42, 43 are not positioned on the exterior side faces of the front end portions of the two flat-type conductors C1, C2, an increase in the size of the counterpart connector 2 in the up-down direction can be avoided.

As can be seen in FIG. 9 (A), the upper counterpart terminals 30 have an upper base portion 31 of a substantially quadrangular planar configuration, an upper long arm portion 32 and an upper short arm portion 33 that extend rearwardly from the rear end edge (the end edge extending in the up-down direction on side X2) of the upper base portion 31, an upper leg portion 34 that extends downwardly from the bottom edge of the front end portion of the upper base portion 31, and an upper connecting portion 35 that extends forwardly from the bottom end of the upper leg portion 34.

The upper base portion 31 has formed therein press-fitting protrusions 31A that protrude from the upper edge of the upper base portion 31 at an intermediate location and a front end location in the forward-backward direction. The upper counterpart terminals 30 are retained in place within the counterpart housing 50 as a result of being press-fitted from the front into the hereinafter-described upper retaining groove portions 50B-1A of the counterpart housing 50 such that the press-fitting protrusions 31A are brought into biting engagement with the interior surface of the upper retaining groove portions 50B-1A (see FIG. 11 (A)).

The upper long arm portion 32 extends forwardly from the rear end edge of the bottom portion of the upper base portion 31 and is resiliently deformable in the up-down direction. An upper rear counterpart contact portion 32A, which is brought into contact with the upper contact portions C1A-1 of the upper flat-type conductor C1 from below under contact pressure, is formed at the front end of the upper long arm portion 32 so as to protrude upward in a substantially triangular configuration. In the up-down direction, the upper rear counterpart contact portion 32A protrudes to substantially the same height as the hereinafter-described upper front counterpart contact portion 33A of the upper short arm portion 33.

The upper short arm portion 33, which is positioned upwardly of the upper long arm portion 32 and extends forwardly from the rear end edge of the vertically intermediate portion of the upper base portion 31, is resiliently deformable in the up-down direction. An upper front counterpart contact portion 33A, which is brought into contact with the upper contact portions C1A-1 of the upper flat-type conductor C1 from below under contact pressure, is formed at the front end of the upper short arm portion 33 so as to protrude upward in a substantially triangular configuration. The upper short arm portion 33 is made slightly shorter than the upper long arm portion 32, and the front end of the upper short arm portion 33 is positioned forwardly (on side X1) of the front end of the upper long arm portion 32. In other words, the upper front counterpart contact portion 33A of the upper short arm portion 33 is positioned forwardly of the upper rear counterpart contact portion 32A of the upper long arm portion 32.

Figure 11A:
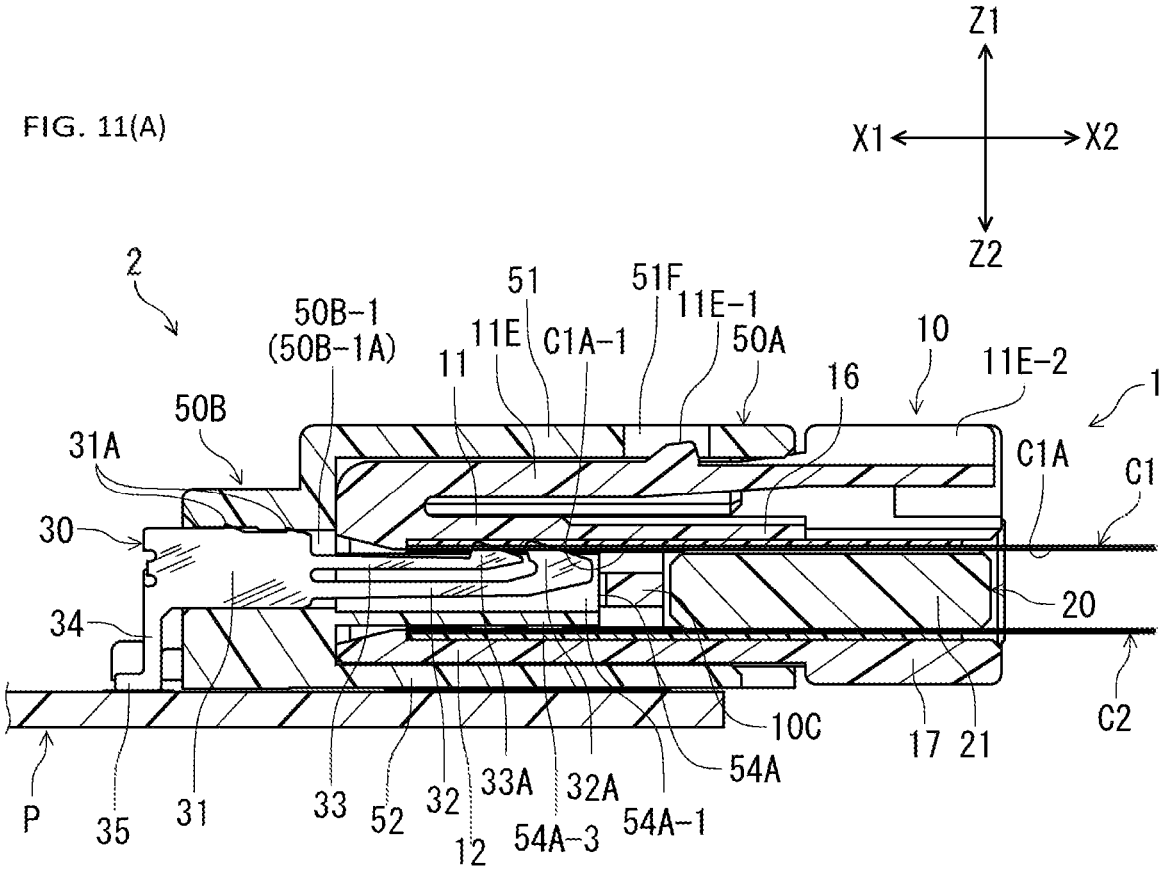
FIGS. 11 (A) and 11 (B) Cross-sectional views of the electrical connector assembly of FIG. 2 in a plane perpendicular to the connector width direction, wherein FIG. 11 (A) shows a cross-section taken across an upper counterpart terminal, and FIG. 11 (B) shows a cross-section taken across a lower counterpart terminal.
Figure 11B:
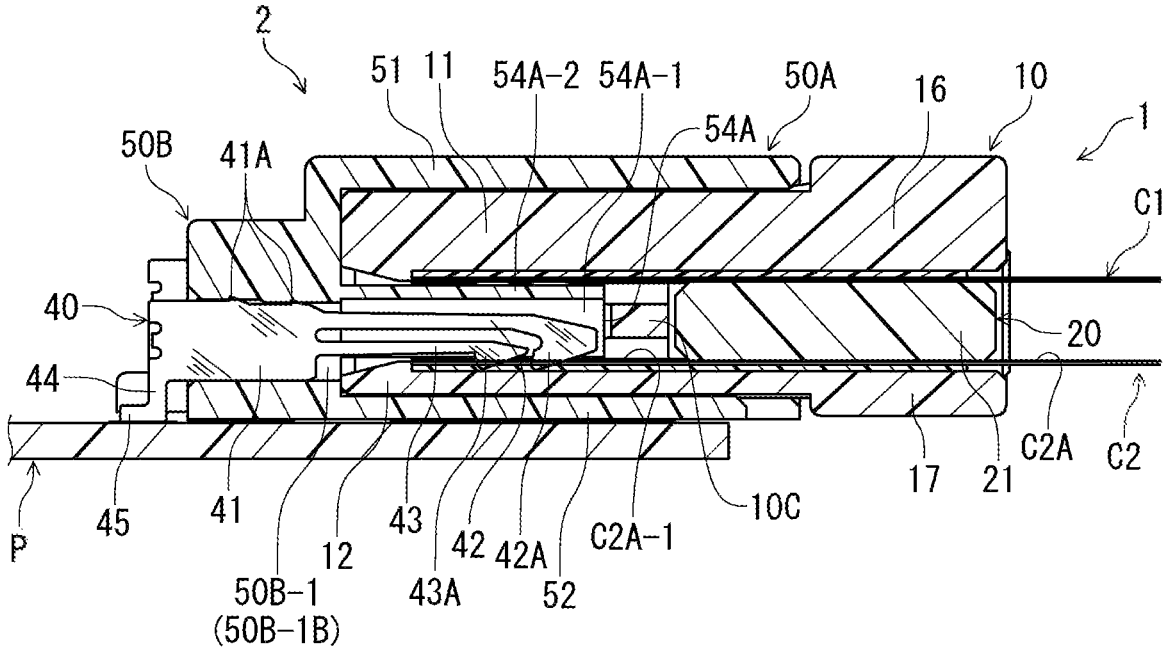

As can be seen in FIG. 3 and FIG. 11 (A), the upper rear counterpart contact portion 32A and upper front counterpart contact portion 33A are positioned substantially level with each other and are located adjacent to each other in the forward-backward direction. In addition, as can be seen in FIG. 11 (A), the upper rear counterpart contact portion 32A and upper front counterpart contact portion 33A, which are positioned within the hereinafter-described counterpart receiving space 50C so as to protrude beyond the top face of the hereinafter-described nesting portion 54 of the counterpart housing 50, are enabled to contact the upper contact portions C1A-1 of the upper flat-type conductor C1. In the present embodiment, allowing a two-point contact with the upper contact portions C1A-1 to be made in this manner ensures an adequate state of contact with the upper contact portions C1A-1.

The upper leg portion 34 extends downwardly from the bottom edge of the upper base portion 31 in a rectilinear manner. When the counterpart connector 2 is mounted to a circuit board P (see FIG. 1), the upper connecting portions 35 are positioned level with the corresponding circuits (not shown) formed on the mounting face of the circuit board P (see FIG. 11 (A)) and can be solder-connected to said corresponding circuits.

As can be seen in FIG. 9 (B), the lower counterpart terminals 40 are shaped by inverting the shape of the upper base portion 31 (except for the press-fitting protrusions 31A), upper long arm portion 32, and upper short arm portion 33 of the upper counterpart terminals 30 while making the upper leg portion 34 shorter. In FIG. 9 (B), the sections of the lower counterpart terminals 40 that correspond to the sections of the upper counterpart terminals 30 are indicated by assigning reference numerals obtained by adding "10" to the reference numerals of the upper counterpart terminals 30. In other words, the lower counterpart terminals 40 have a lower base portion 41, a lower long arm portion 42, a lower short arm portion 43, a lower leg portion 44, and a lower connecting portion 45, and are enabled to contact the lower contact portions C2A-1 of the lower flat-type conductor C2 with the lower rear counterpart contact portion 42A of the lower long arm portion 42 and the lower front counterpart contact portion 43A of the lower short arm portion 43 under contact pressure from above (see FIG. 11 (B)). In addition, the lower base portion 41, lower long arm portion 42, and lower short arm portion 43 of the lower counterpart terminals 40 are positioned further downward of the upper base portion 31, upper long arm portion 32, and upper short arm portion 33 of the upper counterpart terminals 30 proportionately to the smaller length of the lower leg portion 44 in comparison with the upper leg portion 34 of the upper counterpart terminals 30.

As can be seen in FIG. 9 (B), the lower base portion 41 has formed therein press-fitting protrusions 41A that protrude from the upper edge of the lower base portion 41 at an intermediate location and a front end location in the forward-backward direction. The lower counterpart terminals 40 are retained in place within the counterpart housing 50 as a result of being press-fitted from the front into the hereinafter-described lower retaining groove portions 50B-1B of the counterpart housing 50 such that the press-fitting protrusions 41A are brought into biting engagement with the interior surface of the lower retaining groove portions 50B-1B (see FIG. 11 (B)).

In the present embodiment, the upper counterpart terminals 30 and lower counterpart terminals 40 are positioned within ranges that partially overlap in the up-down direction when viewed in the connector width direction. Therefore, the upper counterpart terminals 30 and lower counterpart terminals 40 can share space within the vertical range with each other, which makes it possible to reduce the dimensions of the counterpart connector 2 and, by extension, the connector 1 in the up-down direction. In addition, although in the present embodiment the arm portions 32, 33 of the upper counterpart terminals 30 and the arm portions 42, 43 of the lower counterpart terminals 40 are positioned in a partially overlapping relationship in the up-down direction even in the free state, overlapping in the free state is not of the essence. For example, the arm portions of the upper counterpart terminals and the arm portions of the lower counterpart terminals may be configured to be non-overlapping in the free state while allowing the ranges of their resilient displacement to at least partially overlap in the up-down direction in the state of resilient deformation, and a reduction in the vertical dimensions of the counterpart connector and, by extension, the connector, will still be possible even with such a configuration.

As can be seen in FIG. 8, along with having a counterpart mating portion 50A that mates with the housing 10 of the connector 1 in a section thereof that has a substantially rectangular parallelepiped-like exterior configuration whose longitudinal direction is the connector width direction (Y-direction) and that extends from a location proximate to the front end toward the rear end, the counterpart housing 50 has a counterpart terminal retaining portion 50B used to retain the counterpart terminals 30, 40 in place by way of press-fitting in its front end section.

The counterpart mating portion 50A has a counterpart top wall 51 and a counterpart bottom wall 52 serving as counterpart mating walls that extend in the connector width direction and that are opposed in the up-down direction, a pair of counterpart side walls 53 that extend in the up-down direction at the opposite ends in the connector width direction and that couple the counterpart top wall 51 to the counterpart bottom wall 52, and a nesting portion 54 that extends forwardly from the rear end face of the counterpart terminal retaining portion 50B through the interior space of the counterpart mating portion 50A. A ring-like space rearwardly open between the counterpart top wall 51, counterpart bottom wall 52, and counterpart side walls 53 is formed as a counterpart receiving space 50C intended for receiving the mating portion 10A of the connector 1.

Counterpart protruding walls 51A-51C, which protrude from the bottom face of the counterpart top wall 51 while extending in the forward-backward direction, are formed in the counterpart top wall 51 at four locations in the connector width direction. Specifically, as can be seen in FIG. 8, the counterpart protruding walls 51A-51D include a first counterpart protruding wall 51A, a second counterpart protruding wall 51B, a third counterpart protruding wall 51C, and a fourth counterpart protruding wall 51D arranged in a spaced relationship successively from side Y1 to side Y2. The first counterpart protruding wall 51A and the fourth counterpart protruding wall 51D are made wider in the connector width direction, and the second counterpart protruding wall 51B and the third counterpart protruding wall 51C are made narrower than the first counterpart protruding wall 51A and the fourth counterpart protruding wall 51D. In addition, the second counterpart protruding wall 51B is made slightly wider than the third counterpart protruding wall 51C.

The first counterpart protruding wall 51A is positioned in alignment with the space between the first protruding wall 11A and the second protruding wall 11B of the connector 1 in the connector width direction. The second counterpart protruding wall 51B is positioned in alignment with the space between the second protruding wall 11B and the locking arm portion 11E of the connector 1 in the connector width direction. The third counterpart protruding wall 51C is positioned in alignment with the space between the locking arm portion HE and the third protruding wall 11C of the connector 1 in the connector width direction. The fourth counterpart protruding wall 51D is positioned in alignment with the space between the third protruding wall 11C and the fourth protruding wall 11D of the connector 1 in the connector width direction. These counterpart protruding walls 51A-51D are configured to enter the respective corresponding spaces in the connector 1 from the front when the connectors are in a mated state.

Figure 10B:
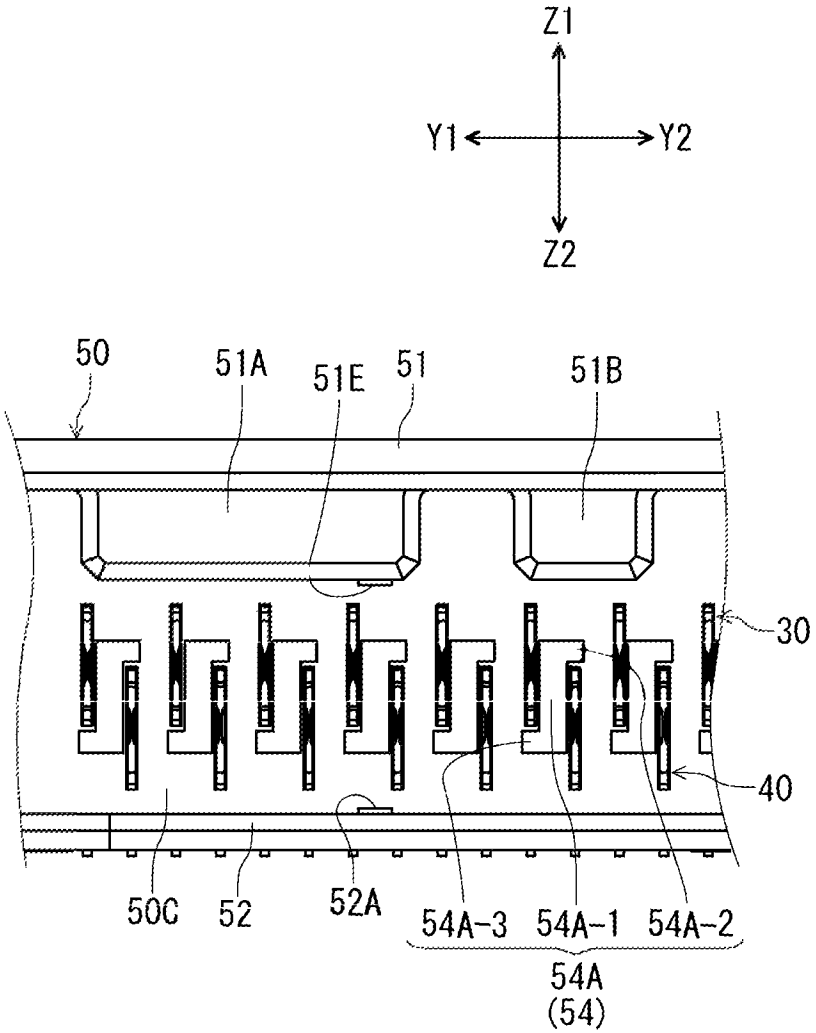
FIG. 10 (A) is a partial enlarged view of the counterpart electrical connector of FIG. 8 as viewed from underneath, and FIG. 10 (B) is a partial enlarged view of the counterpart electrical connector of FIG. 8 from the rear.
Figure 10A:
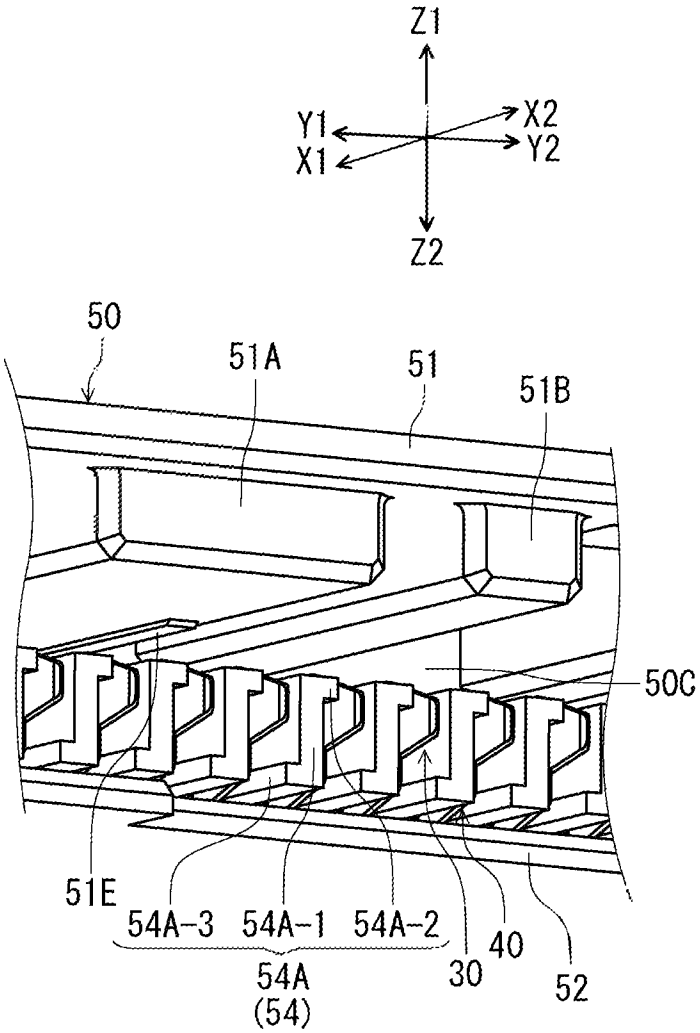

Rib-like upper support protrusions 51E extending in the forward-backward direction are formed on the bottom faces of the first counterpart protruding wall 51A and the fourth counterpart protruding wall 51D. The upper support protrusion 51E of the first counterpart protruding wall 51A is illustrated in FIG. 10 (A, B), wherein said upper support protrusion 51E is formed largely within the front half of the first counterpart protruding wall 51A so as to protrude from the bottom face of the first counterpart protruding wall 51A at a location proximate to side Y2 in the connector width direction while extending in the forward-backward direction. When viewed in the connector width direction, the upper support protrusion 51E extends in the forward-backward direction over a range comprising the respective protruding apex portions of the upper rear counterpart contact portions 32A and upper front counterpart contact portions 33A of the upper counterpart terminals 30 (see FIG. 12 (B)). In addition, the upper support protrusion 51E is positioned in alignment with the top groove portion 11F positioned between the first protruding wall 11A and second protruding wall 11B of the connector 1 in the forward-backward direction as well as in the connector width direction.

In addition, although not shown, the upper support protrusion 51E of the fourth counterpart protruding wall 51D is similar in shape to the upper support protrusion 51E of the first counterpart protruding wall 51A and is formed at a location proximate to side Y1 in the connector width direction. The upper support protrusion 51E of the fourth counterpart protruding wall 51D is positioned in alignment with the top groove portion 11F positioned between the third protruding wall 11C and the fourth protruding wall 11D of the connector 1 in the forward-backward direction as well as in the connector width direction.

As described hereinafter, the respective upper support protrusions 51E are configured such that the upper support protrusions 51E enter the top groove portions 11F from the front and the top face of the front top wall 11 of the housing 10 is supported by the protruding apical faces, that is, the bottom end faces, of the upper support protrusions 51E when the connectors are in a mated state.

In addition, a locking aperture 51F, which extends through the counterpart top wall 51 in the up-down direction, is formed in the rear end portion of the counterpart top wall 51 at a central location in the connector width direction, that is, at a location between the second counterpart protruding wall 51B and the third counterpart protruding wall 51C. As described hereinafter, the locking aperture 51F serves to prevent the decoupling of the connector 1 by engaging the locking protrusion 11E-1 of the connector 1.

Lower support protrusions 52A of the same shape as the upper support protrusions are formed on the counterpart bottom wall 52 in the shape of ribs protruding from the bottom face of the counterpart bottom wall 52, and extend in the forward-backward direction at the respective locations opposing the upper support protrusion 51E of the first counterpart protruding wall 51A and the upper support protrusion 51E of the fourth counterpart protruding wall 51D (not shown) of the counterpart top wall 51 in the up-down direction (see FIG. 8).

Rib-like lateral support protrusions 53A, which protrude from the interior surface of the counterpart side walls 53 while extending in the forward-backward direction, are formed on the counterpart side walls 53 at locations that are proximate to the front end and intermediate in the up-down direction. In addition, forwardly and downwardly open fitting retaining groove portions 53B extending in the forward-backward direction are formed in the counterpart side walls 53 in a slit-like configuration extending in a direction perpendicular to the connector width direction.

The nesting portion 54 has a plurality of nesting ridge portions 54A extending forwardly from the rear face of the counterpart terminal retaining portion 50B and arranged in the connector width direction. As can be seen in FIG. 10 (B), the nesting ridge portions 54A, which have a partition wall portion 54A-1 extending in the up-down direction when viewed in the forward-backward direction, an upper limiting ridge portion 54A-2 protruding from the lateral face on side Y2 in the upper portion of the partition wall portion 54A-1, and a lower limiting ridge portion 54A-3 protruding from the lateral face on side Y1 in the bottom portion of the partition wall portion 54A-1, are of a substantially crank-shaped configuration when viewed in the forward-backward direction.

When the counterpart terminals 30, 40 are retained in place within the counterpart housing 50, the upper long arm portions 32 and upper short arm portions 33 of the upper counterpart terminals 30 extend along the lateral faces of the partition wall portions 54A-1 located on side Y1 (see FIG. 10 (B), FIG. 11 (A)), while the lower long arm portions 42 and lower short arm portions 43 of the lower counterpart terminals 40 extend along the lateral faces of the partition wall portions 54A-1 located on side Y2 (see FIG. 10 (B), FIG. 11 (A)). In addition, the upper long arm portions 32 and upper short arm portions 33 are positioned within the space located directly above the lower limiting ridge portion 54A-3, such that excessive downward resilient displacement of the upper long arm portions 32 is limited by the lower limiting ridge portion 54A-3. In addition, the lower long arm portions 42 and lower short arm portions 43 are positioned within the space located directly below the upper limiting ridge portion 54A-2, such that excessive upward resilient displacement of the lower long arm portions 42 is limited by the upper limiting ridge portion 54A-2.

As can be seen in FIGS. 11 (A) and 11 (B), counterpart terminal retaining groove portions 50B-1 intended for retaining the counterpart terminals 30, 40 in place by way of press-fitting are formed in the counterpart terminal retaining portion 50B in a slit-like configuration extending through the counterpart terminal retaining portion 50B in the forward-backward direction. Specifically, upper retaining groove portions 50B-1A that hold the upper base portions 31 of the upper counterpart terminals 30 (see FIG. 11 (A)) and lower retaining groove portions 50B-1B that hold the lower base portions 41 of the lower counterpart terminals 40 (see FIG. 11 (A)) are formed in an alternating manner in the connector width direction. As can be seen in FIG. 11 (A, B), the upper retaining groove portions 50B-1A are formed at locations proximate to the top end of the counterpart terminal retaining portion 50B, and the lower retaining groove portions 50B-1B are formed at locations proximate to the bottom end of the counterpart terminal retaining portion 50B.

The anchor fittings 60, which are made by bending sheet metal members in the through-thickness direction, have retained portions 61, which are retained by way of press-fitting in the fitting retaining groove portions 53B formed in the counterpart side walls 53 of the counterpart housing 50, and anchoring portions 62, which are secured using solder connections to corresponding portions P1 (see FIG. 1) formed as pads on the mounting face of the circuit board pad. The major faces (faces perpendicular to the through-thickness direction) of the retained portions 61 are at right angles to the connector width direction. The anchoring portions 62, which are obtained by bending the bottom ends of the retained portions 61 at right angles and extend outwardly in the connector width direction, are solder-connected at their bottom faces to the corresponding portions.

The counterpart connector 2 is assembled in accordance with the following procedure. First, the upper base portions 31 of the upper counterpart terminals 30 are press-fitted from the front into the upper retaining groove portions 50B-1A of the counterpart housing 50 while the lower base portions 41 of the lower counterpart terminals 40 are press-fitted from the front into the lower retaining groove portions 50B-1B of the counterpart housing 50. Next, the retained portions 61 of the anchor fittings 60 are press-fitted into the fitting retaining groove portions 53B of the counterpart housing 50 from the rear. As a result, the anchor fittings 60 are retained in place within the counterpart housing 50, which completes the assembly of the counterpart connector 2. The order of attachment (press-fitting) of the counterpart terminals 30, 40 and anchor fittings 60 to the counterpart housing 50 is not limited to the order described above, such that either one may come first or, alternatively, the attachment may be simultaneous.

The connector 1 and counterpart connector 2 are matingly connected in accordance with the following procedure. First, the counterpart connector is mounted to a circuit board P by solder-connecting the connecting portions 35, 45 of the counterpart terminals 30, 40 of the counterpart connector 2 to the corresponding circuits of the circuit board P and, in addition, solder-connecting the anchoring portions 62 of the anchor fittings 60 to the corresponding portions P1 of the circuit board P.

Next, as can be seen in FIG. 1, after positioning the connector 1 at the rear of the counterpart connector 2, the connector 1 is moved forward, thereby mating the mating portion 10A of the connector 1 with the counterpart mating portion 50A of the counterpart connector 2 from the rear.

In the process of connector mating, the mating portion 10A enters the counterpart receiving space 50C from the rear and the locking protrusion 11E-1 of the locking arm portion 11E abuts the rear end portion of the counterpart top wall 51 of the counterpart housing 50, which causes downward resilient deformation and allows the connector 1 to advance further. In addition, in the process of connector mating, the protruding walls 11A-11D of the connector 1 enter the corresponding spaces in the counterpart connector 2 from the rear while the counterpart protruding walls 51A-51D of the counterpart connector 2 enter the corresponding spaces in the connector 1 from the front. As a result, misalignment of the protruding walls 11A-11D in the connector width direction is limited by the counterpart protruding walls 51A-51D, and the connector 1 is smoothly guided forward.

As the connector 1 advances further and the locking protrusion 11E-1 reaches the location of the locking aperture 51F of the counterpart top wall 51, the locking arm portion 11E returns to the free state and the locking protrusion 11E-1 enters the locking aperture 51F from below. As a result, as can be seen in FIG. 11 (A), the locking protrusion 11E-1 is enabled to rearwardly engage the interior surface of the locking aperture 51F, which results in a locked state wherein inadvertent decoupling of the counterpart connector 2 is prevented.

In addition, in the process of connector mating, the nesting ridge portions 54A of the nesting portion 54 of the counterpart housing 50, as well as the upper long arm portions 32 and upper short arm portions 33 of the upper counterpart terminals 30 and the lower long arm portions 42 and lower short arm portions 43 of the lower counterpart terminals 40 arranged in the nesting ridge portions 54A, enter the corresponding front receiving spaces 10D in the connector 1, that is to say, the respective front receiving spaces 10D separated by the plurality of partition walls 14, from the front. As a result, once they are in a downwardly resiliently deformed state, the upper long arm portions 32 and upper short arm portions 33 are brought into contact with the upper contact portions C1A-1 of the upper flat-type conductor C1 under contact pressure by way of the upper rear counterpart contact portions 32A and upper front counterpart contact portions 33A (see FIG. 11 (A)). In addition, once they are in an upwardly resiliently deformed state, the lower long arm portions 42 and lower short arm portions 43 are brought into contact with the lower contact portions C2A-1 of the lower flat-type conductor C2 under contact pressure by way of the lower rear counterpart contact portions 42A and lower front counterpart contact portions 43A (see FIG. 11 (B)). Consequently, the upper flat-type conductor C1 is placed in electrical communication with the upper counterpart terminals 30, and the lower flat-type conductor C2 is placed in electrical communication with the lower counterpart terminals 40.

Although in FIG. 11 (A, B) the arm portions 32, 33, 42, 43 are illustrated in a state in which none of them is subject to resilient deformation and the counterpart contact portions 32A, 33A, 42A, 43A overlap with the contact portions C1A-1, C2A-1 of the flat-type conductors C1, C2, in actual fact, as discussed previously, the arm portions 32, 33, 42, 43 are subject to resilient deformation, and the counterpart contact portions 32A, 33A, 42A, 43A are brought into contact with the contact portions C1A-1, C2A-1 of the flat-type conductors C1, C2 by way of their protruding apex portions.

In addition, the upper support protrusions 51E formed on the first counterpart protruding wall 51A and fourth counterpart protruding wall 51D of the counterpart top wall 51 of the counterpart housing 50 enter the respectively corresponding top groove portions 11F from the front, and the top face of the front top wall 11 of the housing 10 is supported by the protruding apical faces, i.e., the bottom end faces, of the upper support protrusions 51E (see FIG. 11 (B, C)). On the other hand, the lower support protrusions 52A formed on the counterpart bottom wall 52 of the counterpart housing 50 enter the corresponding bottom groove portions 12A from the front, and the top face of the front bottom wall 12 of the housing 10 is supported by the protruding apical faces, i.e., the top end faces, of the lower support protrusions 52A (see FIG. 11 (C)). In this manner, the counterpart top wall 51 and counterpart bottom wall 52 support the exterior surfaces of the front top wall 11 and counterpart bottom wall 52 (the top face of the front top wall 11 and the bottom face of the counterpart bottom wall 52), not with all their interior surfaces (the bottom face of the counterpart top wall 51 and the top face of counterpart bottom wall 52) but locally with the respective protruding apex portions of the upper support protrusions 51E and lower support protrusions 52A, thereby providing for more reliable support.

The upper support protrusions 51E and lower support protrusions 52A enter the top groove portions 11F and bottom groove portions 12A, as a result of which the upper support protrusions 51E work in conjunction with the top groove portions 11F and the lower support protrusions 52A work in conjunction with the bottom groove portions 12A to limit the relative movement of the connector 1 and counterpart connector 2 in the connector width direction and favorably position both connectors 1, 2 in the connector width direction.

In the present embodiment, when viewed in the connector width direction, the support protrusions 51E, 52A are positioned extending over a range comprising the locations of contact between the contact portions C1A-1, C2A-1 of the flat-type conductors C1, C2 and the counterpart contact portions 32A, 33A, 42A, 43A of the counterpart terminals 30, 40. Therefore, even if the wall thickness of the front top wall 11 and front bottom wall 12 of the connector 1 is small, the protruding apical faces of the support protrusions 51E, 52A minimize the resilient deformation of the front top wall 11 and front bottom wall 12 by supporting the top face of the front top wall 11 and the bottom face of the front bottom wall 12 within the above-mentioned range, and thus ensure an adequate contact pressure between the contact portions C1A-1, C2A-1 of the flat-type conductors C1, C2 and the counterpart contact portions 32A, 33A, 42A, 43A of the counterpart terminals 30, 40 at the locations of contact.

In the present embodiment, the respective rear ends of the upper support protrusions 51E and lower support protrusions 52A extend to a more rearward position than the respective rear ends of the top groove portions 11F and bottom groove portions 12A. As a result, the upper support protrusions 51E are brought into biting engagement with the top face of the front top wall 11 while the lower support protrusions 52A are brought into biting engagement with the bottom face of the front bottom wall 12, thereby enabling the position of both connectors 1, 2 to be fixed in the connector width direction. In FIG. 12 (B), the sections where the rear end portions of the upper support protrusions 51E have been brought into biting engagement with the top face of the front top wall 11 are illustrated by showing overlaps between the rear end portions of the upper support protrusions 51E and the front top wall 11.

In addition, the top ridge portions 11G of the front top wall 11 and the bottom ridge portions 12B of the front bottom wall 12 of the connector 1 are brought into biting engagement with the bottom face of the counterpart top wall 51 and the top face of the counterpart bottom wall 52, respectively, thereby enabling the position of both connectors 1, 2 to be fixed in the connector width direction. In FIG. 12 (B), the sections where the top ridge portions 11G have been brought into biting engagement with the bottom face of the counterpart top wall 51 are illustrated by showing overlaps between the rear end portions of the upper support protrusions 51E and the front top wall 11.

Further, when the connectors are in a mated state, the lateral protrusions 13A of the connector 1 abut the interior surface of the counterpart side walls 53 of the counterpart connector 2 while the lateral support protrusions 53A of the counterpart connector 2 abut the interior surfaces of the front side walls 13 of the connector 1, thereby enabling the position of both connectors 1, 2 to be fixed in the connector width direction.

Although in the present embodiment the front top wall 11 and front bottom wall 12 of the housing 10 of the connector 1 are supported by the support protrusions 51E, 52A of the counterpart housing 50, providing the support protrusions 51E, 52A in the counterpart housing 50 is not essential as long as adequate contact pressure between the flat-type conductors and the counterpart terminals can be ensured. In other words, the bottom face of the counterpart top wall and the top face of the counterpart bottom wall of the counterpart housing may be configured to support the top face of the front top wall and the bottom face of the front bottom wall of the housing of the connector without providing support protrusions in the counterpart housing.

DESCRIPTION OF THE REFERENCE NUMERALS

1 Connector (electrical connector with flat-type conductors)
2 Counterpart connector (counterpart electrical connector)
10 Housing
10A Mating portion
10D Front receiving space
11 Front top wall (mating wall)
11F Top groove portion
12 Front bottom wall (mating wall)
12A Bottom groove portion
20 Retainer
30 Upper counterpart terminals
32A Upper rear counterpart contact portion
33A Upper front counterpart contact portion
40 Lower counterpart terminals
42A Lower rear counterpart contact portion
43A Lower front counterpart contact portion
50 Counterpart housing
50A Counterpart mating portion
51 Counterpart top wall (counterpart mating wall)
51E Upper support protrusion
52 Counterpart bottom wall (counterpart mating wall)
52A Lower support protrusion
C1 Upper flat-type conductor
C1A-1 Upper contact portions
C2 Lower flat-type conductor
C2A-1 Lower contact portions

The invention claimed is:

1. An electrical connector, comprising:

at least two flat-type conductors; and a counterpart electrical connector, wherein the flat-type conductors are configured to matingly connecting front end sections of the flat-type conductors with a strip-like configuration extending in a forward-backward direction to the counterpart electrical connector;

a housing holding the front end sections of the flat-type conductors; and a retainer attached to the housing in a manner to support the front end sections of the flat-type conductors, wherein:

the flat-type conductors have a plurality of contact portions for connection to the counterpart electrical connector that are arranged in a strip width direction of the flat-type conductors and are exposed on one of faces of the front end sections;

the flat-type conductors, in which said one faces whereon the contact portions are arranged are used as interior side faces, have a pair of said interior side faces placed in a face-to-face relationship at locations spaced apart from each other in a thickness direction of the flat-type conductors, and have a receiving space for receiving a nesting portion in which the counterpart contact portions of counterpart terminals provided in the counterpart electrical connector are arranged formed between the pair of interior side faces of the front end sections of the flat-type conductors;

the housing has a mating portion which, along with holding and being able to support the front end sections of the flat-type conductors, mates with a counterpart housing provided in the counterpart electrical connector;

the mating portion has mating walls that are in a face-to-face relationship with exterior side faces constituting other faces located on the sides opposed to said one faces of the front end sections of the flat-type conductors, and configured to support exterior side faces of the flat-type conductors with said mating walls; and the retainer is positioned between the flat-type conductors at a different location than the receiving space in the forward-backward direction and is enabled to support the flat-type conductors in conjunction with the housing, wherein the counterpart electrical connector is matingly connected to the electrical connector, the counterpart electrical connector comprising:

a plurality of counterpart terminals arranged in alignment with the plurality of the contact portions of the flat-type conductors; and a counterpart housing retaining the plurality of terminals in place, wherein the plurality of counterpart terminals have one set of counterpart terminals corresponding to one flat-type conductor and another set of counterpart terminals corresponding to an other flat-type conductor, and wherein said one set and said other set of counterpart terminals are configured to be arranged in the nesting portion entering the receiving space of the electrical connector with the flat-type conductors and to be brought into contact with the contact portions of respective corresponding conductors of the flat-type conductors once the counterpart electrical connector is connected to the flat-type conductors.

2. The electrical connector according to claim 1, wherein:

the plurality of counterpart terminals have counterpart contact portions that are configured to be brought into contact with the contact portions of the flat-type conductors by undergoing resilient displacement in the thickness direction of the flat-type conductors;

the counterpart contact portions of the counterpart terminals of said one set of counterpart terminals and the counterpart contact portions of the counterpart terminals of said other set of counterpart terminals are disposed at different locations in the strip width direction of the flat-type conductors; and ranges of resilient displacement between the counterpart contact portions of the counterpart terminals of said one set of counterpart terminals and the counterpart contact portions of the counterpart terminals of said other set of counterpart terminals overlap at least partially in the thickness direction when viewed in the strip width direction of the flat-type conductors once the counterpart electrical connector has been connected to the electrical connector with flat-type conductors and the counterpart contact portions of the plurality of counterpart terminals have been resiliently displaced.

3. The electrical connector according to claim 1, wherein the electrical connector with flat-type conductors and the counterpart electrical connector form an electrical connector assembly, wherein:

the counterpart housing of the counterpart electrical connector has a counterpart mating portion which, along with holding the counterpart contact portions of the plurality of counterpart terminals, receives the mating portion of the housing of the electrical connector with flat-type conductors; and the counterpart mating portion has counterpart mating walls placed in a face-to-face relationship with exterior surfaces of said mating walls once said counterpart mating portion has received the mating portion, and supports the exterior surfaces of the mating walls with interior surfaces of the counterpart mating walls.

4. The electrical connector according to claim 3, wherein:

the counterpart mating walls of the counterpart electrical connector have support protrusions protruding toward the exterior surfaces of the mating walls of the electrical connector with flat-type conductors on interior surfaces of said counterpart mating walls, and, once the counterpart mating portion has received the mating portion, support the exterior surfaces of the mating walls with protruding apical faces of the support protrusions.

5. The electrical connector according to claim 4, wherein:

the mating walls have groove portions that extend along the exterior surfaces of said mating walls in the forward-backward direction and are configured to receive the support protrusions from the front, and the support protrusions, in conjunction with the groove portions, limit a relative movement of the electrical connector with flat-type conductors and the counterpart electrical connector in the strip width direction of the flat-type conductors.

6. The electrical connector according to claim 4, wherein the support protrusions, when viewed in the strip width direction of the flat-type conductors, are formed extending over a range comprising locations of contact between the contact portions of the flat-type conductors and the counterpart contact portions of the counterpart terminals in the forward-backward direction.

* * * * *